US008026887B2

(12) United States Patent
Koo et al.

(10) Patent No.: US 8,026,887 B2
(45) Date of Patent: Sep. 27, 2011

(54) LIQUID CRYSTAL DISPLAY AND DRIVING METHOD THEREOF

(75) Inventors: Sungjo Koo, Daegu (KR); Suhyuk Jang, Daegu (KR); Jongwoo Kim, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 608 days.

(21) Appl. No.: 12/003,756

(22) Filed: Dec. 31, 2007

(65) Prior Publication Data

US 2009/0002301 A1 Jan. 1, 2009

(30) Foreign Application Priority Data

Jun. 28, 2007 (KR) ..... 10-2007-0064561

(51) Int. Cl.
*G09G 3/36* (2006.01)

(52) U.S. Cl. ..... 345/96; 345/209

(58) Field of Classification Search ..... 345/87–104, 345/204, 208–210; 349/123, 124, 126, 128, 349/133, 167, 171, 172
See application file for complete search history.

(56) References Cited

U.S. PATENT DOCUMENTS

| | | | | |
|---|---|---|---|---|
| 5,831,586 | A * | 11/1998 | Hirai et al. | 345/94 |
| 6,680,722 | B1 * | 1/2004 | Hiraki et al. | 345/96 |
| 6,756,957 | B2 | 6/2004 | Park | |
| 7,030,843 | B2 | 4/2006 | Youn | |
| 2002/0050971 | A1 * | 5/2002 | Su et al. | 345/92 |
| 2003/0090450 | A1 * | 5/2003 | Inada et al. | 345/87 |
| 2003/0095091 | A1 * | 5/2003 | Enomoto et al. | 345/87 |
| 2004/0001038 | A1 * | 1/2004 | Ryuh | 345/87 |
| 2004/0178981 | A1 * | 9/2004 | Asada et al. | 345/96 |
| 2004/0189575 | A1 * | 9/2004 | Choi et al. | 345/96 |
| 2005/0104834 | A1 * | 5/2005 | Tsuchihashi | 345/96 |
| 2006/0164362 | A1 * | 7/2006 | Ryuh | 345/96 |
| 2006/0291298 | A1 * | 12/2006 | Kang et al. | 365/189.07 |
| 2007/0001966 | A1 * | 1/2007 | Kim | 345/96 |
| 2008/0001889 | A1 * | 1/2008 | Chun et al. | 345/96 |
| 2008/0001890 | A1 * | 1/2008 | Song et al. | 345/96 |
| 2008/0252624 | A1 * | 10/2008 | Jang et al. | 345/204 |
| 2008/0266233 | A1 * | 10/2008 | Song et al. | 345/99 |

FOREIGN PATENT DOCUMENTS

| | | | |
|---|---|---|---|
| JP | 07-044139 | | 2/1995 |
| JP | 2000-235375 | | 8/2000 |
| JP | 2002-196731 | | 7/2002 |
| JP | 2003255917 | A * | 9/2003 |
| JP | 2006154772 | A * | 6/2006 |

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A liquid crystal display includes a liquid crystal display panel, a timing controller to generate a dynamic charge share control signal to indicate a time at which the gray level of a data voltage is changed from a white gray level to a black gray level and a time at which the polarity of the data voltage is inverted, and to detect weakness patterns and generate a dot inversion control signal for widening a horizontal polarity inversion time of data voltages when the weakness patterns are input, wherein the liquid crystal display panel includes first and second liquid crystal cell groups whose polarity is inverted every 2 frame periods, and a polarity inversion time of the first liquid crystal cell group and a polarity inversion time of the second liquid crystal cell group overlap.

6 Claims, 21 Drawing Sheets

LIQUID CRYSTAL DISPLAY AND DRIVING METHOD THEREOF

This application claims the benefit of the Korean Patent Application No. 2007-0064561 filed on Jun. 28, 2007, which is hereby incorporated by reference.

BACKGROUND OF THE INVENTION

1. Field of the Invention

The present invention relates to a liquid crystal display, and more particularly to a liquid crystal display and a driving method thereof adapted to reduce the generation of heat and power consumption of a data driving circuit, prevent DC image sticking and flicker, and prevent degradation of picture quality when displaying data of weakness patterns.

2. Discussion of the Related Art

A liquid crystal display is adapted to display images by controlling the light transmittance of liquid crystal cells in response to a video signal. A liquid crystal display of an active matrix type actively controls data by switching a data voltage applied to the liquid crystal cells using a thin film transistor (TFT) formed at every liquid crystal cell Clc, as shown in FIG. 1, thereby improving the picture quality of a motion image. As shown in FIG. 1, reference label "Cst" denotes a storage capacitor for sustaining the data voltage charged in the liquid crystal cell "Clc," "D1" denotes a data line through which the data voltage is supplied, and "G1" denotes a gate line through which a scan voltage is supplied.

The liquid crystal display is driven according to an inversion method in which a polarity is inverted between neighboring liquid crystal cells and a polarity is inverted whenever a frame period is shifted in order to reduce a direct current (DC) offset component and the degradation of liquid crystals. However, the swing width of the data voltage supplied to the data lines whenever the polarity of the data voltage is shifted increases, thereby generating a large amount of current in a data driving circuit. Thus, the problems that arise include increase in heat generating temperature of the data driving circuit and sharp increase in power consumption of the data driving circuit. In order to reduce the swing width of the data voltage supplied to the data lines thereby decreasing the heat generating temperature and power consumption of the data driving circuit, a charge sharing circuit or a precharge circuit is adopted in the data driving circuit. However, the resulting effects are generally not satisfactory.

Further, if the polarity of the data voltage is inverted according to the inversion method, the charging amount of a liquid crystal cell charged with the data voltage of a positive polarity is different from that of a liquid crystal cell charged with the data voltage of a negative polarity. Thus, there is a problem that the picture quality is degraded. For example, as shown in FIG. 2, assuming that a liquid crystal cell is charged with the data voltage of a positive polarity and then with the data voltage of a negative polarity for representing the same gray level as that of the data voltage of the positive polarity, the liquid crystal cell maintains a voltage Vp(+) whose absolute value voltage may be lowered by as much as ΔVp due to parasitic capacitance of the TFT after being charged with the data voltage of the positive polarity. Then, the liquid crystal cell maintains a voltage Vp(−) whose absolute value voltage may be increased by as much as ΔVp due to parasitic capacitance of the TFT after being charged to the data voltage of the negative polarity. Accordingly, a liquid crystal cell of a normally black mode liquid crystal display has light transmitted therethrough with a higher light transmittance when being charged to the data voltage of a negative polarity for representing the same gray level as that of the data voltage of a positive polarity than that of the data voltage of the positive polarity. In the normally black mode, the higher the voltage charged with a liquid crystal cell, the higher the light transmittance of the liquid crystal cell. Further, a liquid crystal cell of a normally white mode liquid crystal display has light transmitted therethrough with a lower light transmittance when charged with the data voltage of a negative polarity for representing the same gray level as that of the data voltage of a positive polarity than that of the data voltage of the positive polarity. In the normally white mode, the higher the voltage charged in a liquid crystal cell, the lower the light transmittance of the liquid crystal cell.

Further, low picture quality may result on a liquid crystal display when a particular data pattern of a specific picture having a particular polarity pattern of a data voltage applied to liquid crystal cells and the gray levels of data is displayed. Representative factors that degrade the picture quality include a phenomenon in which greenish tint is generated on a display screen and flicker in which the luminance of a screen is shifted periodically.

For example, greenish tint may be generated in a display image when a liquid crystal display is driven according to a vertical 2-dot and horizontal 1-dot inversion method (V2H1) in which the polarity of a data voltage charged in the liquid crystal cells every vertical 2-dot (or 2 liquid crystal cells) is inverted and the polarity of a data voltage charged in the liquid crystal cells every horizontal 1-dot (or 1 liquid crystal cell) is inverted and the gray levels of data supplied to odd pixels are white gray levels and the gray levels of data supplied to even pixels are black gray levels within a one frame period, as shown in FIG. 3. In other words, in first, second, fifth, and sixth lines L1, L2, L5, and L6, the data voltage of all green (G) data, which have the greatest influence on the luminance compared to red (R), green (G), and blue (B) data, has a negative polarity. Consequently, greenish tint is generated in the first, second, fifth, and sixth lines of this image. This greenish phenomenon is generated because the green (G) data is biased toward any one polarity. FIG. 4 illustrates another example of when greenish tint may be generated in an image. As shown in FIG. 4, greenish tint is generated in a display image when a liquid crystal display is driven according to a vertical 2-dot and horizontal 1-dot inversion method (V2H1), and the gray levels of data supplied to odd subpixels are white gray levels and the gray levels of data supplied to even subpixels are black gray levels.

Another picture degrading phenomenon occurs when a liquid crystal display is driven according to a vertical 1-dot and horizontal 1-dot inversion method (V1H1) in which the polarity of a data voltage is inverted every vertical 1-dot and horizontal 1-dot such that the polarities of data voltages charged in adjacent liquid crystal cells in vertical and horizontal directions are inverted and the data voltages include a data voltage of a white gray level and a data voltage of a black gray level alternately disposed every one subpixel within a one frame period, as shown in FIG. 5. In this instance, a flicker phenomenon in which the luminance of a display image is shifted every frame period is generated. In other words, all of the data voltages of the white gray levels have a positive polarity and all of the data voltages of the white gray levels in a next frame have a positive polarity within one frame period. Consequently, the luminance of a display image is changed every frame period.

An image in which a white gray level and a black gray level are alternately arranged periodically as shown in FIGS. 3 to 5 is referred to as an image containing a "weakness pattern" since such polarity and gray level patterns degrade the picture quality of a display image.

Another picture degrading phenomenon occurs when any one of two polarities of a data voltage is supplied to a liquid crystal display panel dominantly for a long time, thereby generating image sticking phenomenon. This image sticking is referred to as "DC image sticking" because the phenomenon is generated by a voltage of the same polarity being repeatedly charged to a liquid crystal cell. One example of when DC image sticking occurs is when data voltages of an interlaced video signal are supplied to a liquid crystal display. Data according to an interlace method (hereinafter, referred to as "interlace data") is characterized by data voltages of an image to be displayed on a liquid crystal cell being applied only to odd horizontal lines in odd frame periods and only to even horizontal lines in even frame periods.

FIG. 6 shows a waveform illustrating an example of the interlace data supplied to the liquid crystal cell Clc. For purposes of example, the liquid crystal cell Clc to which the data voltage is supplied, as shown in FIG. 6, is a liquid crystal cell arranged in odd horizontal lines. As shown in FIG. 6, the liquid crystal cell Clc is supplied with a positive voltage during an odd frame period and is supplied with a negative voltage during an even frame period. In the interlace method, a high positive data voltage is supplied to the liquid crystal cell Clc arranged in the odd horizontal line only during odd frame periods. For this reason, the positive data voltage is dominant compared with the negative data voltage as indicated by waveforms within the box shown in FIG. 6 over four frame periods. Consequently, DC image sticking is generated.

FIG. 7 shows an image illustrating an experiment result of DC image sticking that appears due to the interlace data. If an original image as shown on the left side of FIG. 7 is supplied to a liquid crystal display panel for a certain period of time using the interlace method, the amplitude of a data voltage whose polarity is changed every frame period varies between an odd frame and an even frame. As a result, if data voltages of intermediate gray levels (e.g., 127 gray levels) are supplied to all the liquid crystal cells Clc of the liquid crystal display panel after the original image shown on the left side of FIG. 7 is supplied, DC image sticking in which the pattern of the original image appears faintly occurs as shown on the right side of FIG. 7.

Another example of when DC image sticking occurs is when the same image is moved or scrolled at a constant speed. The voltage of the same polarity is repeatedly accumulated in the liquid crystal cell Clc based on the size of the figure being scrolled and the scroll speed (i.e., moving speed), thereby resulting in DC image sticking. FIG. 8 shows an image illustrating an experimental result of DC image sticking that appears when oblique patterns and character patterns are moved at a constant speed.

SUMMARY OF THE INVENTION

Accordingly, the present invention is directed to a liquid crystal display and driving method thereof that substantially obviates one or more problems due to limitations and disadvantages of the related art.

An object of the present invention is to provide a liquid crystal display and a driving method thereof adapted to reduce generation of heat and power consumption of a data driving circuit, prevent DC image sticking and flicker, and prevent degradation of the picture quality when displaying data of weakness patterns.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal display panel having a plurality of data lines, a plurality of gate lines, and a plurality of liquid crystal cells, a timing controller to determine gray levels of input digital video data and a time at which a polarity of a data voltage to be supplied to the data lines is inverted and generate a dynamic charge share control signal to indicate a time at which the gray level of the data voltage is changed from a white gray level to a black gray level and a time at which the polarity of the data voltage is inverted, and to detect weakness patterns in which the data of the white gray level and the black gray level are regularly arranged in the input digital video data and generate a dot inversion control signal for widening a horizontal polarity inversion time of data voltages to be supplied to the data lines when the weakness patterns are input, a data driving circuit to convert the digital video data from the timing controller into the data voltage, change the polarity of the data voltage, supply any one of a common voltage and a charge share voltage between a positive data voltage and a negative data voltage to the data lines in response to the dynamic charge share control signal, and widen the horizontal polarity inversion time of the data voltages in response to the dot inversion control signal, and a gate driving circuit to sequentially supply a scan pulse to the gate lines under the control of the timing controller, wherein the liquid crystal display panel includes first and second liquid crystal cell groups whose polarity is inverted every 2 frame periods, and a polarity inversion time of the first liquid crystal cell group and a polarity inversion time of the second liquid crystal cell group overlap.

In another aspect, a method of driving a liquid crystal display including a liquid crystal display panel having a plurality of data lines, a plurality of gate lines, a plurality of liquid crystal cells, a data driving circuit to convert digital video data into a data voltage to be supplied to the data lines and to convert a polarity of the data voltage, and a gate driving circuit to sequentially supply a scan pulse to the gate lines, the method includes the steps of determining gray levels of digital video data and a time at which the polarity of the data voltage to be supplied to the data lines is inverted, generating a dynamic charge share control signal to indicate a time at which the gray level of the data voltage is changed from a white gray level to a black gray level and a time at which the polarity of the data voltage is inverted, detecting a weakness pattern in which data of the white gray level and the black gray level are regularly arranged in the digital video data and generating a dot inversion control signal to widen a horizontal polarity inversion time of data voltages to be supplied to the data lines when the weakness pattern is input, converting the digital video data into the data voltage, changing the polarity of the data voltage, and supplying any one of a common voltage and a charge share voltage between a positive data voltage and a negative data voltage to the data lines in response to the dynamic charge share control signal, and widening the horizontal polarity inversion time of the data voltages in response to the dot inversion control signal, wherein the liquid crystal display panel includes first and second liquid crystal cell groups whose polarity is inverted every 2 frame periods and a polarity inversion time of the first liquid crystal cell group is controlled to overlap with a polarity inversion time of the second liquid crystal cell group.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 9:
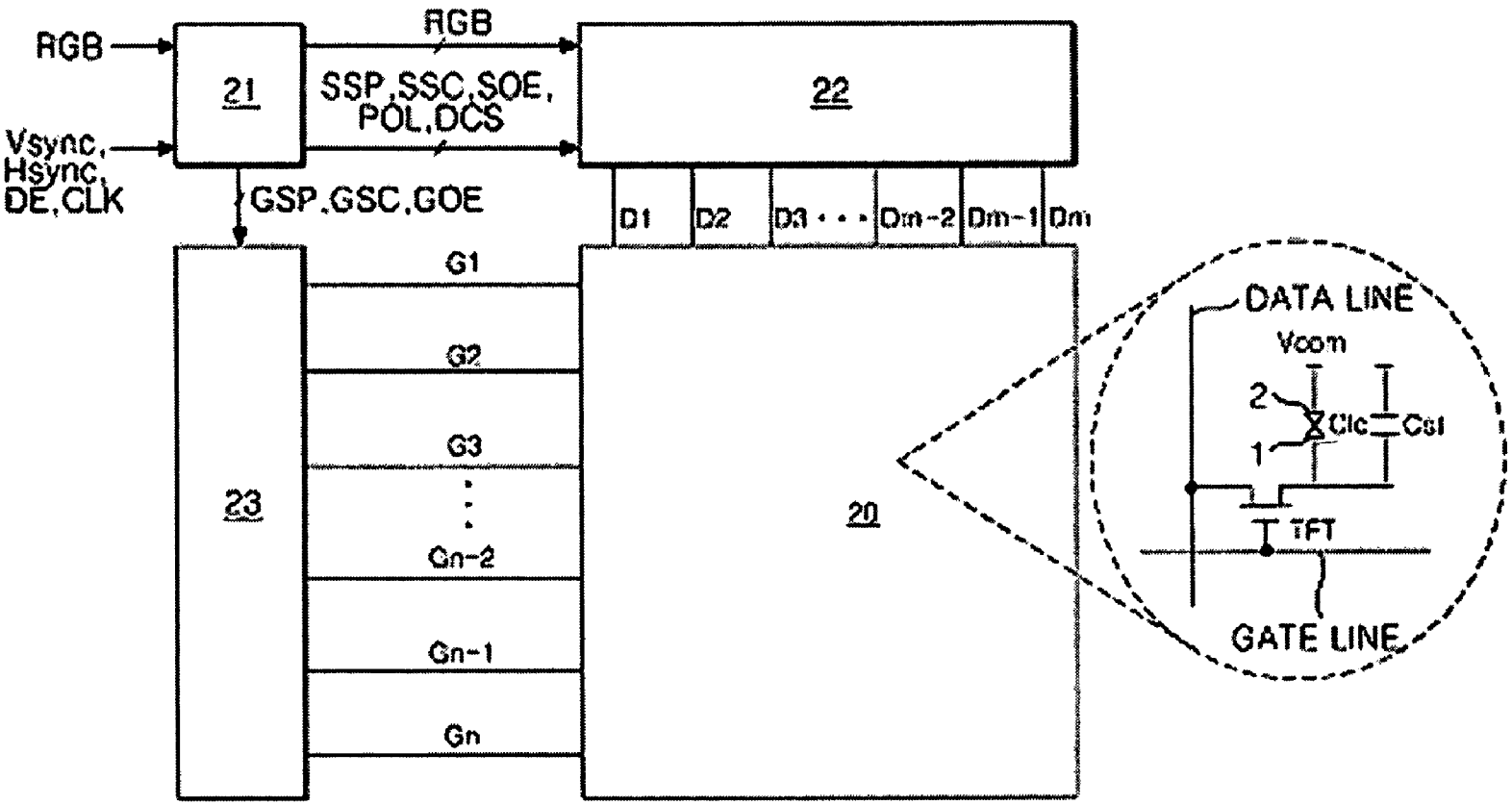
FIG. 9 is a block diagram of a liquid crystal display according to an exemplary embodiment of the present invention.

FIG. 9 is a block diagram of a liquid crystal display according to an exemplary embodiment of the present invention. As shown in FIG. 9, the liquid crystal display according to the exemplary embodiment of the present invention includes a liquid crystal display panel 20, a timing controller 21, a data driving circuit 22, and a gate driving circuit 23. The liquid crystal display panel 20 has liquid crystal molecules injected between two sheets of glass substrates. M data lines D1 to Dm and n gate lines G1 to Gn are formed on a first glass substrate of the liquid crystal display panel 20 so that they cross each other. The liquid crystal display panel 20 includes (m×n) liquid crystal cells Clc disposed in matrix form by the intersecting structure of the data lines D1 to Dm and the n gate lines G1 to Gn. The data lines D1 to Dm, the gate lines G1 to Gn, TFTs, pixel electrodes 1 of the liquid crystal cell Clc connected to the TFT, a storage capacitor Cst, and other components are formed on the first glass substrate of the liquid crystal display panel 20.

A black matrix, a color filter, and a common electrode 2 are formed on a second glass substrate of the liquid crystal display panel 20. The common electrode 2 is formed on the second glass substrate in a vertical electric field mode such as twisted nematic (TN) and vertical alignment (VA). Alternatively, the common electrode 2 is formed on the first glass substrate together with the pixel electrode 1 in a lateral electric field mode such as in-plane switching (IPS) and fringe field switching (FFS). Polarization plates with optical axes that are orthogonal to each other are attached to the first and second glass substrates of the liquid crystal display panel 20, respectively. An orientation film for setting the pre-tilt angle of liquid crystal is formed on an inner surface that contacts the liquid crystal.

The timing controller 21 receives timing signals, such as vertical/horizontal sync signals Vsync, Hsync, a data enable signal DE, and a clock signal CLK and generates control signals for controlling the operation timing of the data driving circuit 22 and the gate driving circuit 23. The control signals include a gate start pulse GSP, a gate shift clock GSC, a gate output enable signal GOE, a source start pulse SSP, a source sampling clock SSC, a source output enable signal SOE, and a polarity control signal POL. The gate start pulse GSP controls a start horizontal line where scanning begins in one vertical period where one screen is displayed. The gate shift clock GSC is a timing control signal input to a shift register of the gate driving circuit 23 to sequentially shift the gate start pulse GSP and is generated with a pulse width corresponding to the on-period of a TFT. The gate output enable signal GOE indicates the output of the gate driving circuit 23. The source start pulse SSP controls a start pixel in one horizontal line in which data will be displayed. The source sampling clock SSC controls the latch operation of data within the data driving circuit 22 based on the rising or falling edge. The source output enable signal SOE controls the output of the data driving circuit 22. The polarity control signal POL controls the polarity of a data voltage to be supplied to the liquid crystal cells Clc of the liquid crystal display panel 20.

The timing controller 21 checks for a time at which a gray level value of data is changed from a white gray level to a black gray level during 2 horizontal periods by analyzing the gray level of the data and also checks for a time at which the polarity of a data voltage is inverted. The timing controller 21 generates a dynamic charge sharing signal (hereinafter, referred to as "DCS") for reducing the generation of heat and power consumption of the data driving circuit 22 based on the check result of the data and polarity.

The timing controller 21 also controls the polarity of a data voltage output from the data driving circuit 22 according to the polarity control signal POL and the dot inversion control signal DINV in order to prevent DC image sticking and flicker in a display picture. The liquid crystal cells are charged with a data voltage having the same polarity during 2 horizontal periods under the control of the timing controller 21. However, data inversion periods of a first liquid crystal cell group and a second liquid crystal cell group arranged in the liquid crystal cells overlap. Further, the timing controller 21 checks input data and controls the data driving circuit 22 according to a horizontal 1-dot inversion method (H1), which has a better picture quality than that of a horizontal 2-dot inversion method (H2), when data other than data of weakness patterns are detected. When data of weakness patterns are detected, the timing controller 21 changes the polarity of a data voltage according to the horizontal 2-dot inversion method (H2) in which greenish or flicker is not generated. To switch to the horizontal 2-dot inversion method (H2), the dot inversion control signal DINV is generated as a high logic, whereas to switch to the horizontal 1-dot inversion method (H2), the dot inversion control signal DINV is generated as a low logic.

The data driving circuit 22 latches digital video data RGB under the control of the timing controller 21, converts the digital video data into analog positive/negative gamma compensation voltages, generates positive/negative data voltages, and supplies the data voltages to the data lines D1 to Dm. A vertical inversion period of the data voltage polarity is determined according to the polarity control signal POL, and a horizontal inversion period of the data voltage polarity is determined according to the dot inversion control signal DINV. The vertical inversion period is a polarity inversion time of data voltages consecutively supplied to the respective data lines and is a polarity inversion time of liquid crystal cells that are vertically adjacent to one another. The horizontal inversion period is a polarity inversion time of data voltages supplied to the data lines D1 to Dm and is a polarity inversion time of liquid crystal cells that are horizontally adjacent to one another.

Further, the data driving circuit 22 supplies a common voltage Vcom or a charge share voltage to the data lines D1 to Dm by performing charge sharing only when the gray level of data is changed from a white gray level to a black gray level and when the polarity of a data voltage supplied to the liquid crystal display panel 20 is inverted in response to the source output enable signals SOE and DCS. The common voltage Vcom is an intermediate voltage between a data voltage of a positive polarity and a data voltage of a negative polarity. The charge share voltage is an average voltage generated when a data line to which the data voltage of a positive polarity is supplied and a data line to which the data voltage of a negative polarity is supplied are shorted.

In known charge sharing driving methods, charge sharing is performed between data unconditionally. In such a case, since all the data voltages supplied to the data lines D1 to Dm rise from the common voltage Vcom or a charge sharing voltage, the swing widths of the data voltages supplied to the data lines D1 to Dm and the number of the rising edges of the data voltages are increased. Thus, the generation of heat and consumption power of the data driving circuit 22 are thereby increased. By contrast, in accordance with the present invention, charge sharing is performed only when the gray level of data is changed from the white gray level to the black gray level and the polarity of the data voltages supplied to the liquid crystal display panel 20 is inverted. Accordingly, the swing widths of the data voltages supplied to the data lines D1 to Dm and the number of the rising edges of the data voltages are reduced.

The gate driving circuit 23 includes a plurality of gate drive integrated circuits each of which includes a shift register, a level shifter for changing the output signal of the shift register to a signal having a swing width suitable for TFT driving of a liquid crystal cell, and an output buffer connected between the level shifter and the gate lines G1 to Gn. The gate driving circuit 23 is configured to sequentially output scan pulses having a pulse width of approximately one horizontal period.

Figure 10:
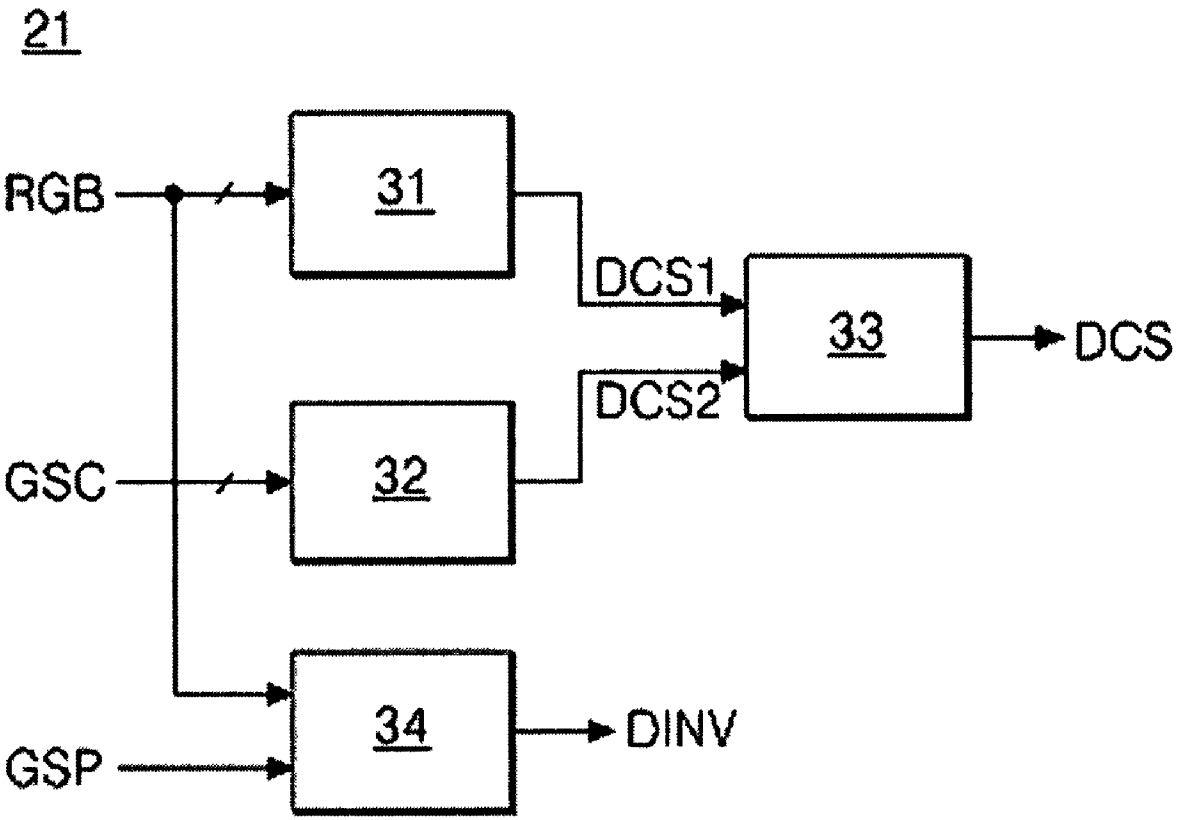
FIG. 10 is a block diagram of a dynamic charge share (DCS) generating circuit and a dot inversion control signal generating circuit.

FIG. 10 is a block diagram of an exemplary DCS generating circuit that may be embedded in the timing controller 21, for example. As shown in FIG. 10, the timing controller 21 includes a data check unit 31, a polarity check unit 32, a DCS generator 33, and a dot inversion control signal generator 34. The data check unit 31 determines whether two data consecutively input change from a white gray level W to a black gray level B by analyzing a gray level value of the digital video data RGB. The gray level is a gray level with respect to each data or a representative gray level of one line. Based on the data analysis, the data check unit 31 generates a first DCS signal DCS1 indicating a time at which the digital video data RGB is changed from the white gray level W to the black gray level B.

The polarity check unit 32 determines a time at which the polarity of a data voltage to be supplied to the liquid crystal display panel 20 is inverted by counting the gate shift clock GSC and generates a second DCS signal DCS2 indicating the polarity inversion time point. For example, if the data voltage is supplied to the liquid crystal display panel 20 according to the vertical 2-dot inversion method, the polarity check unit 32 counts the gate shift clock GSC, divide the count value into two, and determine a time at which the remainder becomes 0 as being the time at which the polarity of data is inverted.

The DCS generator 33 performs an AND operation, for example, on the first DCS signal DCS1 and the second DCS signal DCS2 and generates a final DCS signal. The DCS signal generated from the DCS generator 33 enables charge sharing driving of the data driving circuit 22 only when data is changed from the white gray level to the black gray level and the polarity of a data voltage supplied to the liquid crystal display panel 20 is inverted. At all other times, the DCS signal blocks charge sharing driving of the data driving circuit 22.

Figure 1:
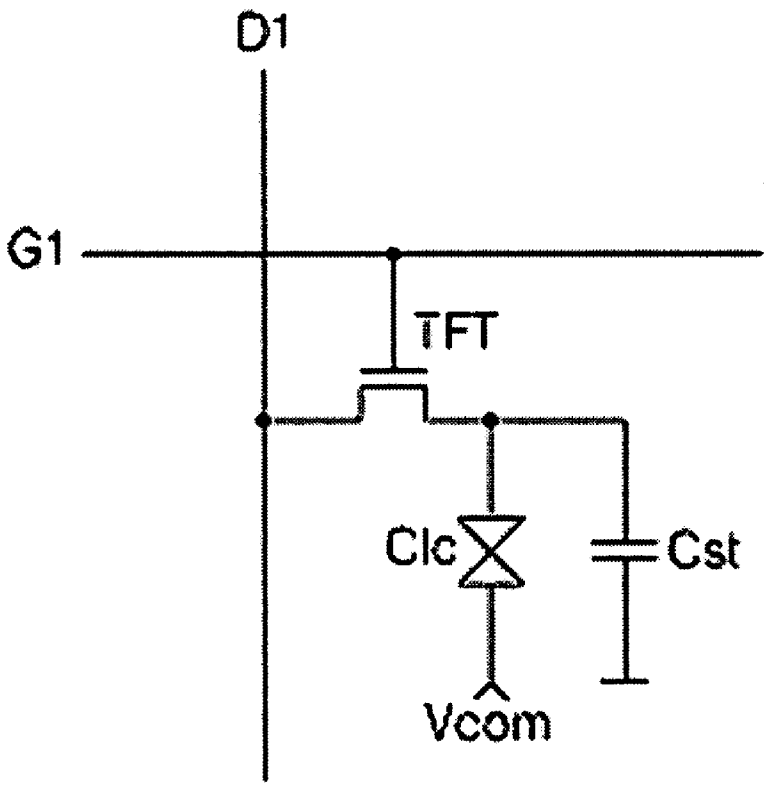
Fig. 1 [RELATED ART]
FIG. 1 is an equivalent circuit diagram of a liquid crystal cell of a liquid crystal display.
Figure 2:
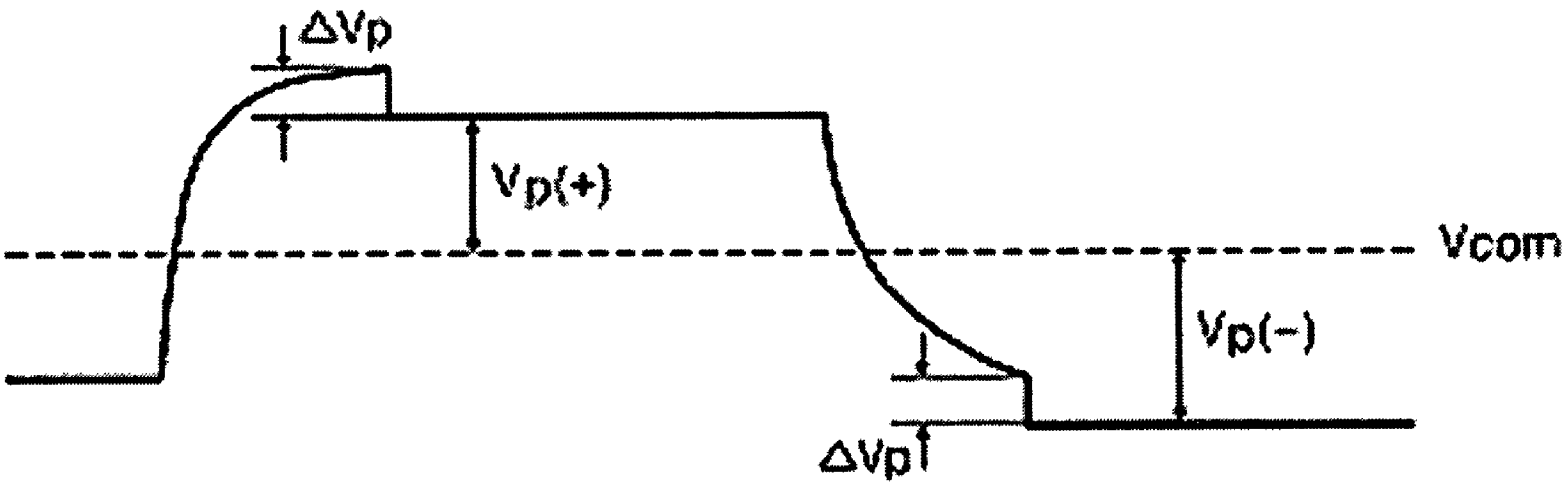
Fig. 2 [RELATED ART]
FIG. 2 is a waveform diagram illustrating a data voltage of a positive polarity and a data voltage of a negative polarity of the same gray level charged in a liquid crystal cell.
Figure 3:
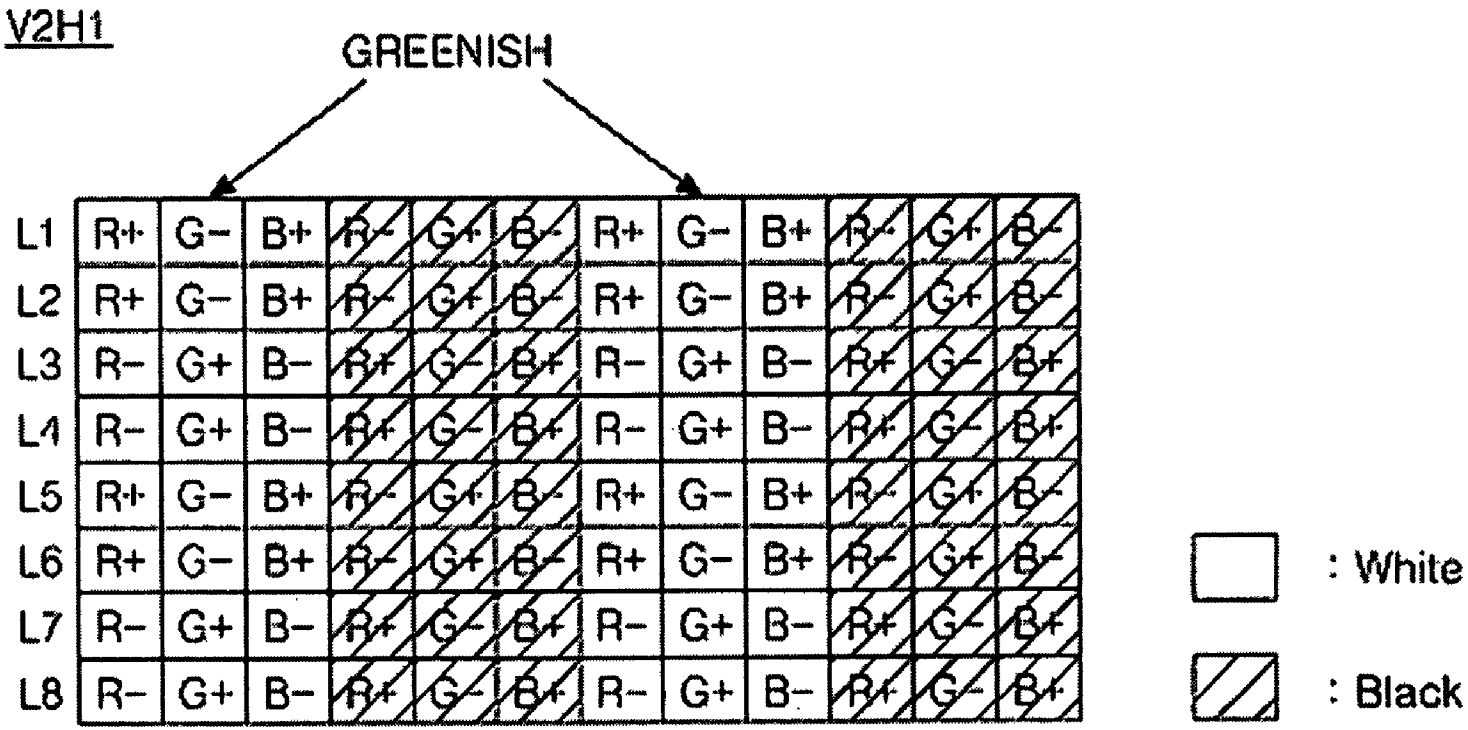
Fig. 3 [RELATED ART]
FIG. 3 is a view illustrating a greenish phenomenon of a display image due to a first weakness pattern.
Figure 4:
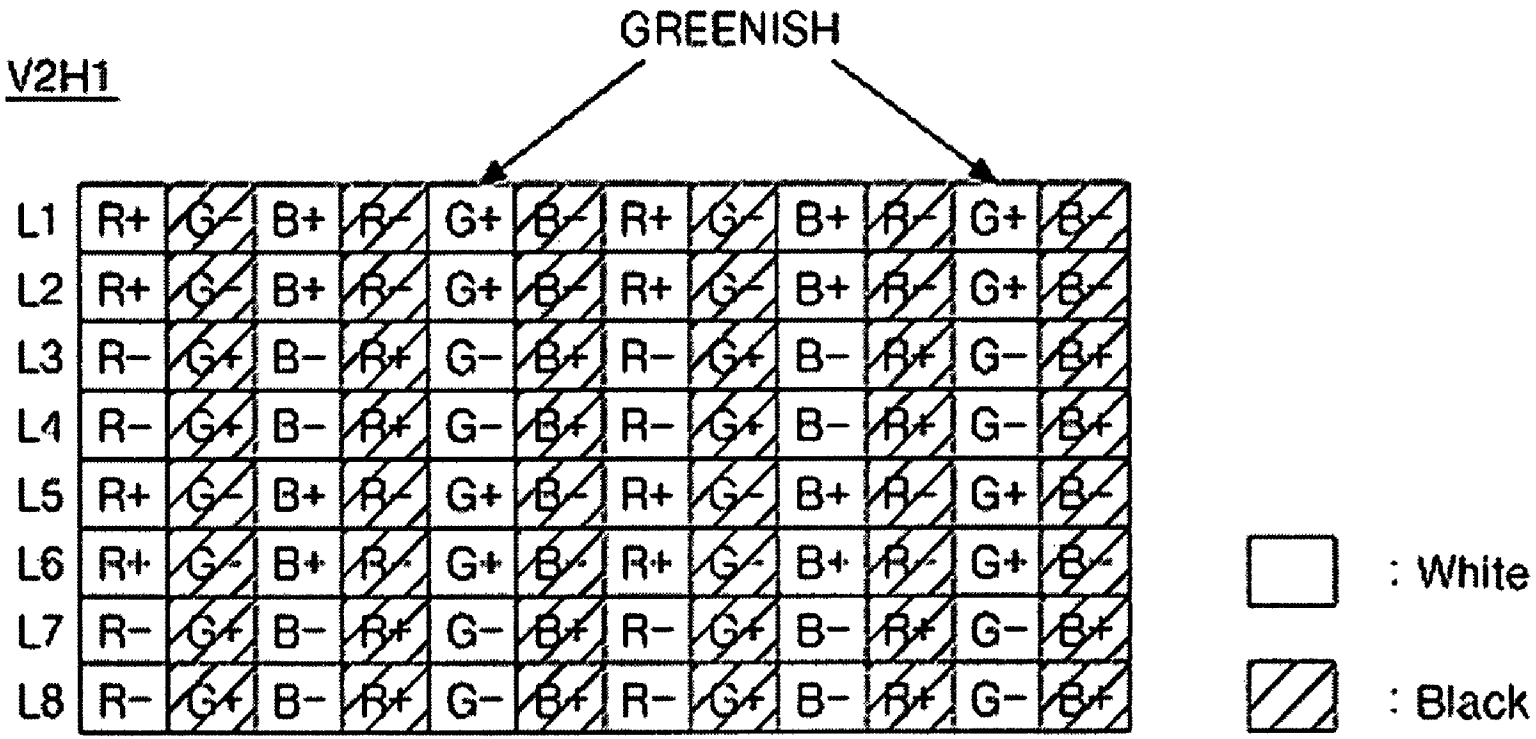
Fig. 4 [RELATED ART]
FIG. 4 is a view illustrating a greenish phenomenon of a display image due to a second weakness pattern.
Figure 5:
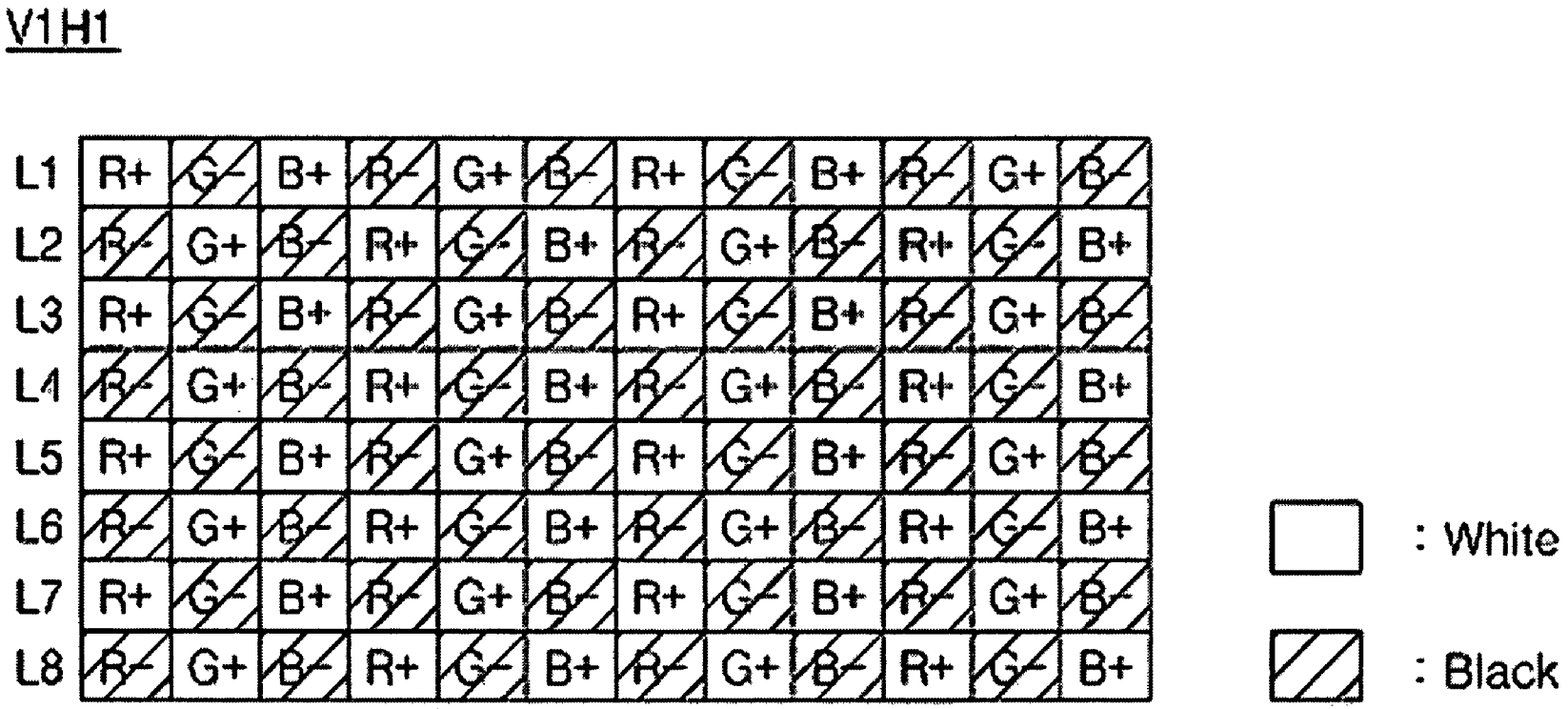
Fig. 5 [RELATED ART]
FIG. 5 is a view illustrating a flicker phenomenon of a display image due to a third weakness pattern.
Figure 6:
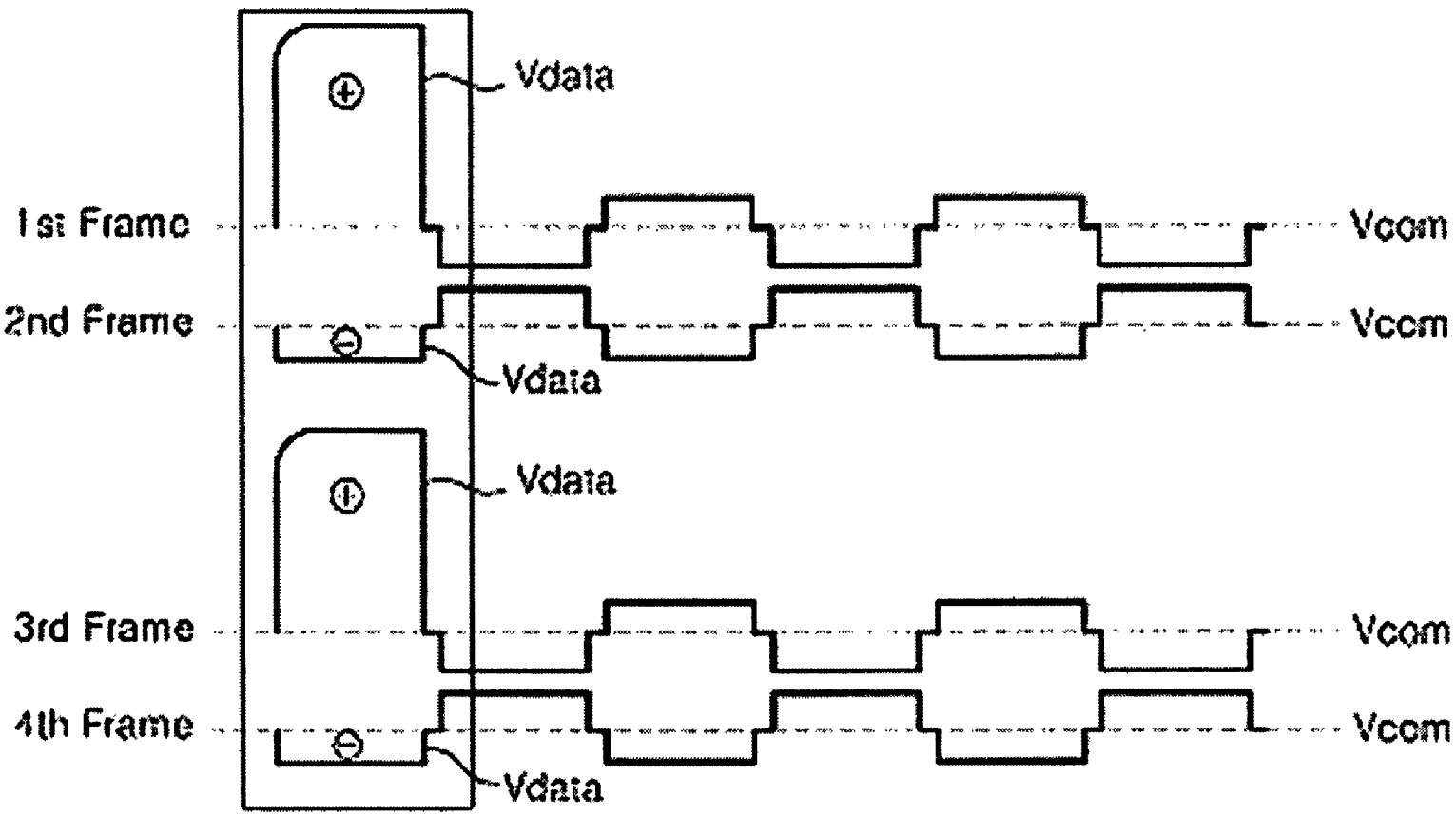
FIG. 6 is a waveform diagram illustrating an example of interlace data.
Figure 7:
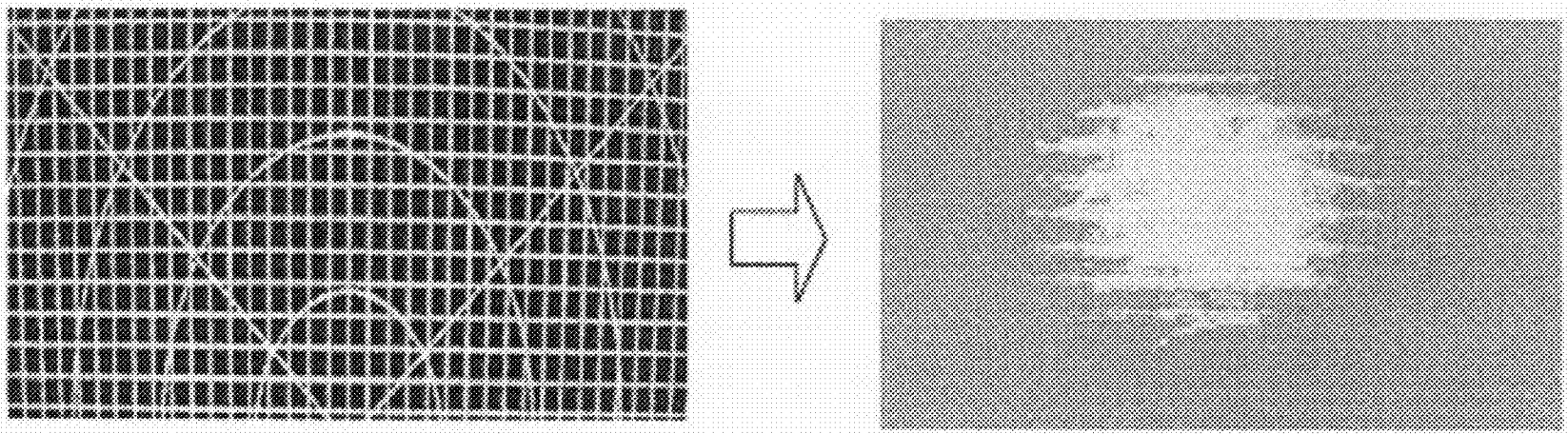
FIG. 7 illustrates an experimental result showing DC image sticking due to interlace data.
Figure 8:
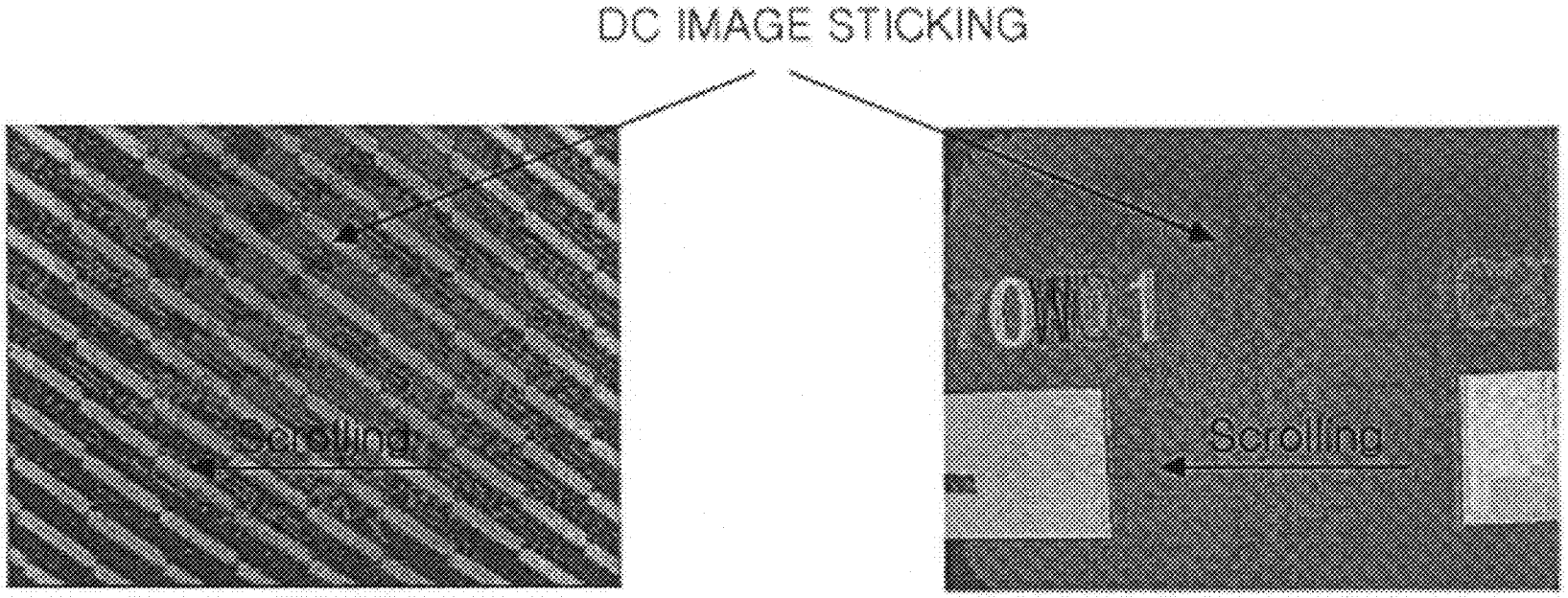
FIG. 8 illustrates an experimental result showing DC image sticking due to scroll data.

The dot inversion control signal generator 34 detects a data pattern in which picture quality may be degraded (i.e., weakness pattern), such as greenish tint or flicker, since the white gray level and the black gray level are regularly arranged, as shown in FIGS. 3 to 5, by checking the input digital video data RGB. The dot inversion control signal generator 34 also generates a high logic dot inversion control signal DINV when weakness patterns are input and generates a low logic dot inversion control signal DINV when data patterns other than the weakness patterns are input.

Figure 11:
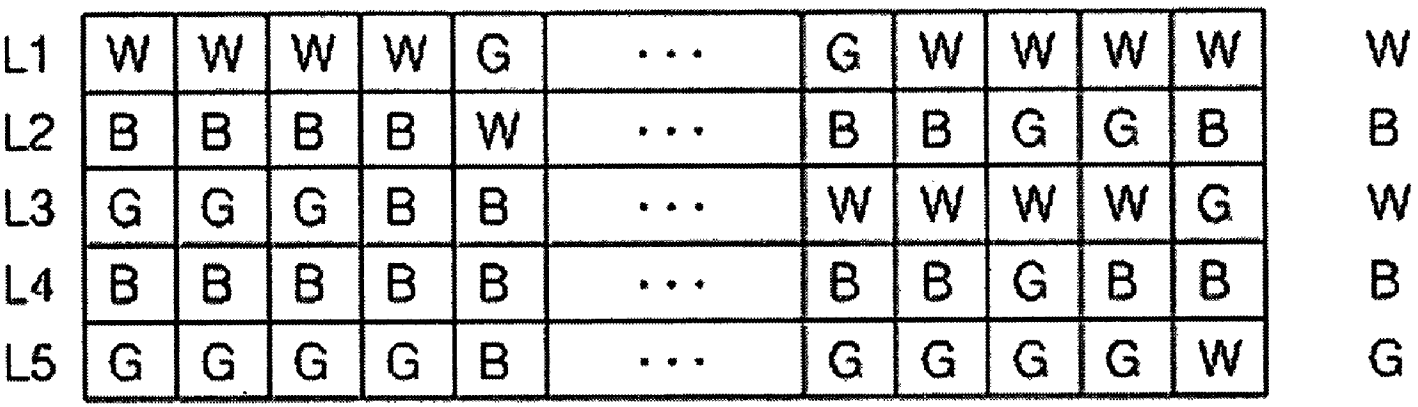
FIGS. 11 and 12 are views illustrating data check examples of a data check unit 31 shown in FIG. 10.
Figure 12:
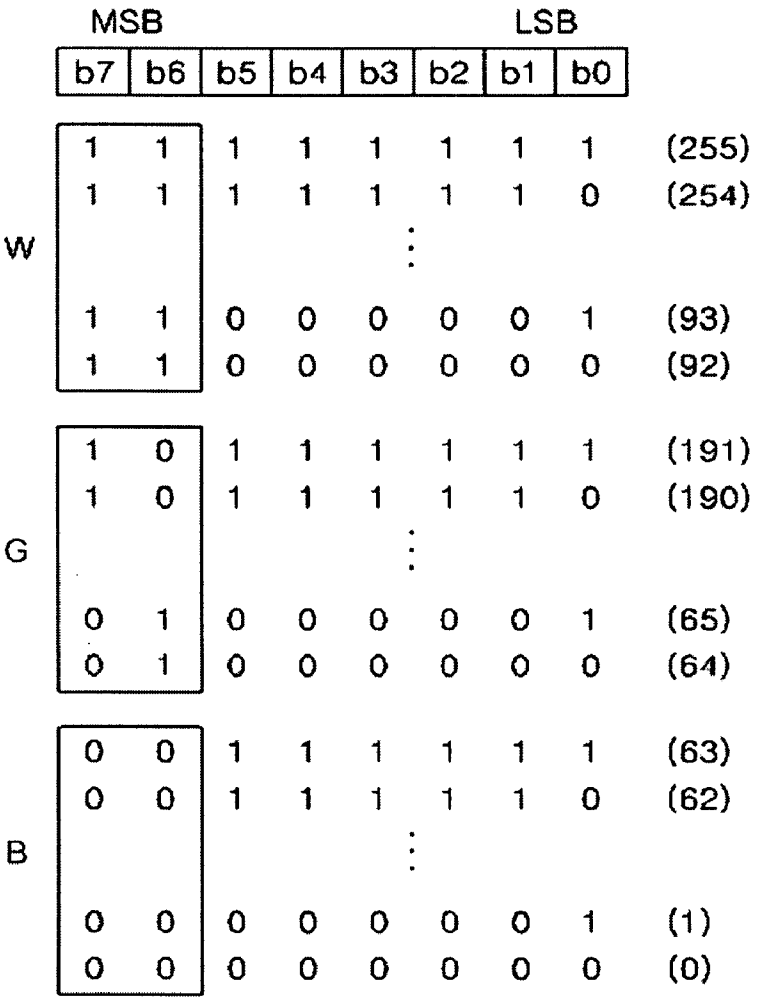

FIGS. 11 and 12 illustrate examples of data check processed in the data check unit 31. FIG. 11 is an example showing the gray levels of data supplied to liquid crystal cells arranged in five lines, and FIG. 12 illustrates the gray levels of the digital video data. The data check unit 31 determines the gray level of each data included in one line and determines a representative gray level. For example, when data of one line includes 1366 data and 50% or more of the data (e.g., 683) have a white gray level W, the data check unit 31 designates the representative gray level of the line as white gray level W (e.g., lines L1 and L3), as shown in FIG. 11. When 50% or more of the data has a gray gray level G, the data check unit 31 designates the representative gray level of the line as gray gray level G (e.g., line L5), as shown in FIG. 11. When 50% or more of the data has a black gray level B, the data check unit 31 designates the representative gray level of the line as black gray level B (e.g., lines L2 and L4), as shown in FIG. 11. While in this example 50% is the criterion of the representative gray level, the threshold may be changed according to the driving characteristic of the liquid crystal panel without departing from the scope of the present invention.

In the present example, the gray level of data is determined only using the most significant 2 bits (MSB) of the digital video data as shown in FIG. 12. When one data is an 8-bit data, the MSB of upper gray levels (e.g., 192 to 255) are "11," the MSB of intermediate gray levels (e.g., 64 to 191) are "10" or "01," and the MSB of lower gray levels (e.g., 0 to 63) are "00." Thus, when the most significant 2 bits of the digital video data RGB are "11," the data check unit 31 determines the gray level of the data as white gray level W, when the most significant 2 bits of the digital video data RGB are "10" or "01," the data check unit 31 determines the gray level of the data as the gray gray level. G, and when the most significant 2 bits of the digital video data RGB are "00," the data check unit 31 determines the gray level of the data as the black gray level B.

Figure 13A:
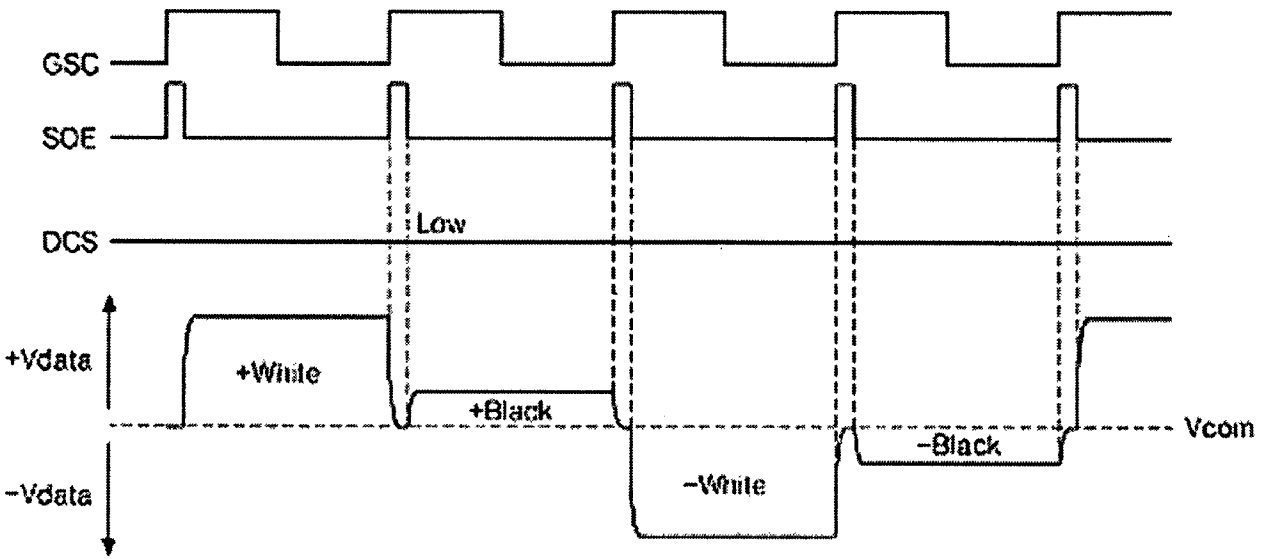
FIGS. 13A to 13C are waveform diagrams illustrating dynamic charge sharing of the liquid crystal display according to an exemplary embodiment of the present invention.
Figure 13B:
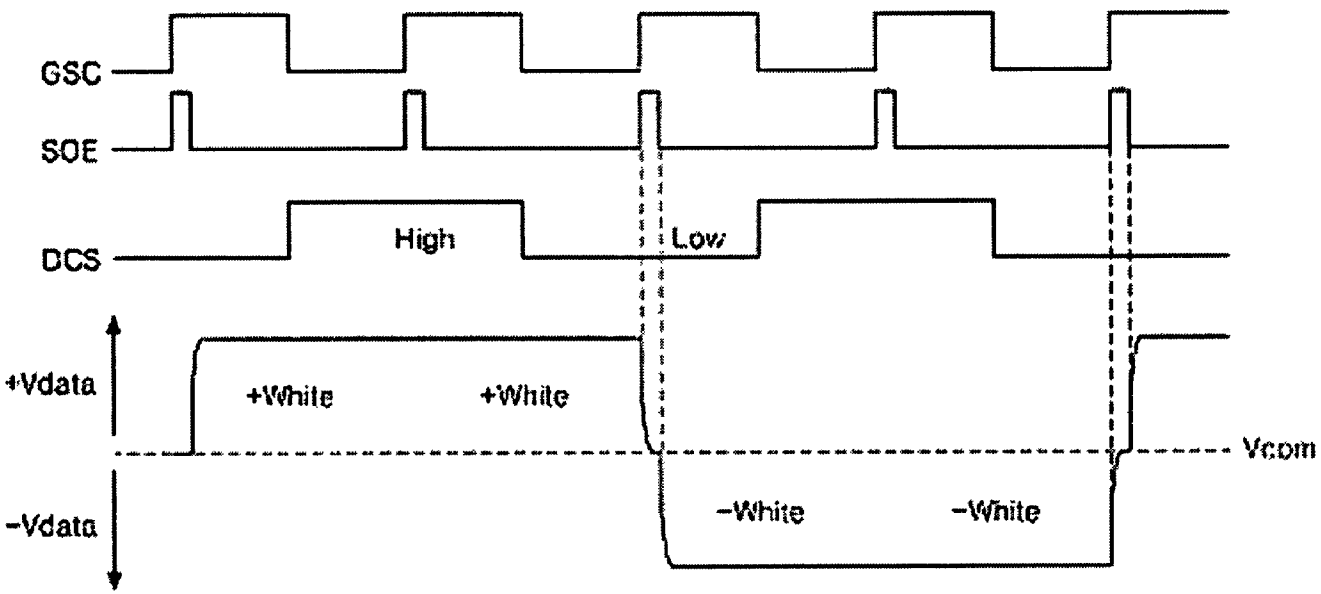
Figure 13C:
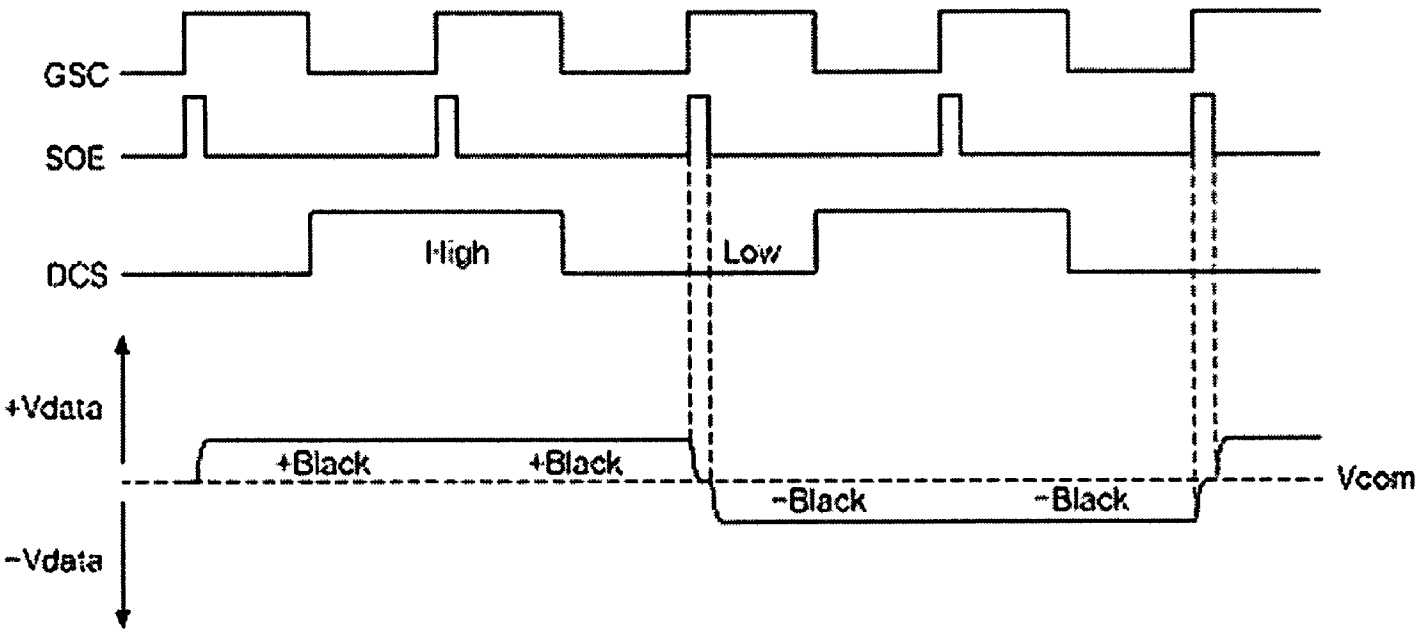

FIGS. 13A to 13C are waveform diagrams illustrating an example of a DCS operation of the liquid crystal display according to an exemplary embodiment of the present invention. The waveforms shown in FIGS. 13A to 13C illustrate when the liquid crystal display according to an exemplary embodiment of the present invention is driven according to the vertical 2-dot inversion method (V2).

The data driving circuit 22 performs charge sharing during a non-scan period where gray levels of two data to be supplied to two liquid crystal cells vertically adjacent to each other or representative gray levels of data to be supplied to two lines adjacent to each other are changed from the white gray level W to the black gray level B, as shown in FIG. 13A. Further, the data driving circuit 22 performs charge sharing during a non-scan period where the polarity of two data voltages to be supplied to two liquid crystal cells vertically adjacent to each other is changed. However, the data driving circuit 22 blocks charge sharing when gray levels of two data to be supplied to two liquid crystal cells vertically adjacent to each other or representative gray levels of data to be supplied to two lines adjacent to each other are changed from the black gray level B to the white gray level W, from the black gray level B to the gray gray level G, from the white gray level W to the white gray level W as shown in FIG. 13B, or from the black gray level B to the black gray level B as shown in FIG. 13C. Accordingly, the swing widths and the number of the rising edges of the data voltages supplied to the data lines D1 to Dm are reduced, thereby decreasing the generation of heat and power consumption of the data driving circuit 22.

The data driving circuit 22 performs charge sharing when the DCS signal is a low logic and the source output enable signal SOE is a high logic, as shown in FIGS. 13A to 13C. On the other hand, the data driving circuit 22 does not perform charge sharing when the DCS signal is a high logic even if the source output enable signal SOE is a logic high and supplies the data voltages to the data lines D1 to Dm. Further, the data driving circuit 22 supplies the data voltages to the data lines D1 to Dm irrespective of the logic level of the DCS signal when the source output enable signal SOE is a low logic.

Figure 14:
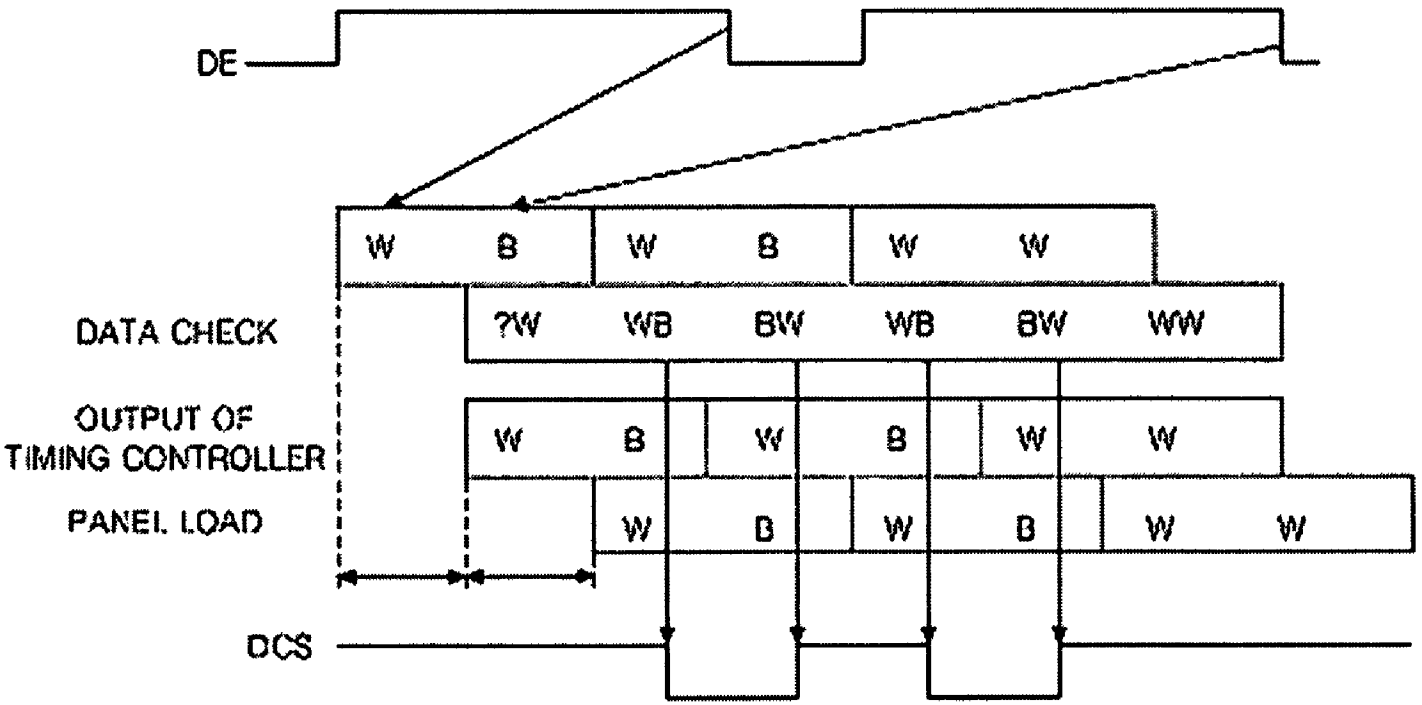
FIG. 14 is a waveform diagram illustrating data check of the timing controller and a data flow between the timing controller and the data driving circuit.

In the driving method of the liquid crystal display according to an exemplary embodiment of the present invention, data of an input image are checked every line. The data check method includes analyzing information about the gray levels of two line data during a period from a time at which data are input to the timing controller 21 at every line to a time at which data are supplied to the liquid crystal display panel 20 (hereinafter, referred to as "panel load time point"), as shown in FIG. 14. During the data analysis, information about the gray levels of the two line data is analyzed based on time from the data transmission timing of the timing controller 21 to the operation timing of the data driving circuit 22 and the panel load time point. Accordingly, addition of additional memory to an existing timing controller and memory is not required, and information about the gray levels of data may be analyzed at every line without changing the data flow of the timing controller 20 and the data driving circuit 22.

Figure 15:
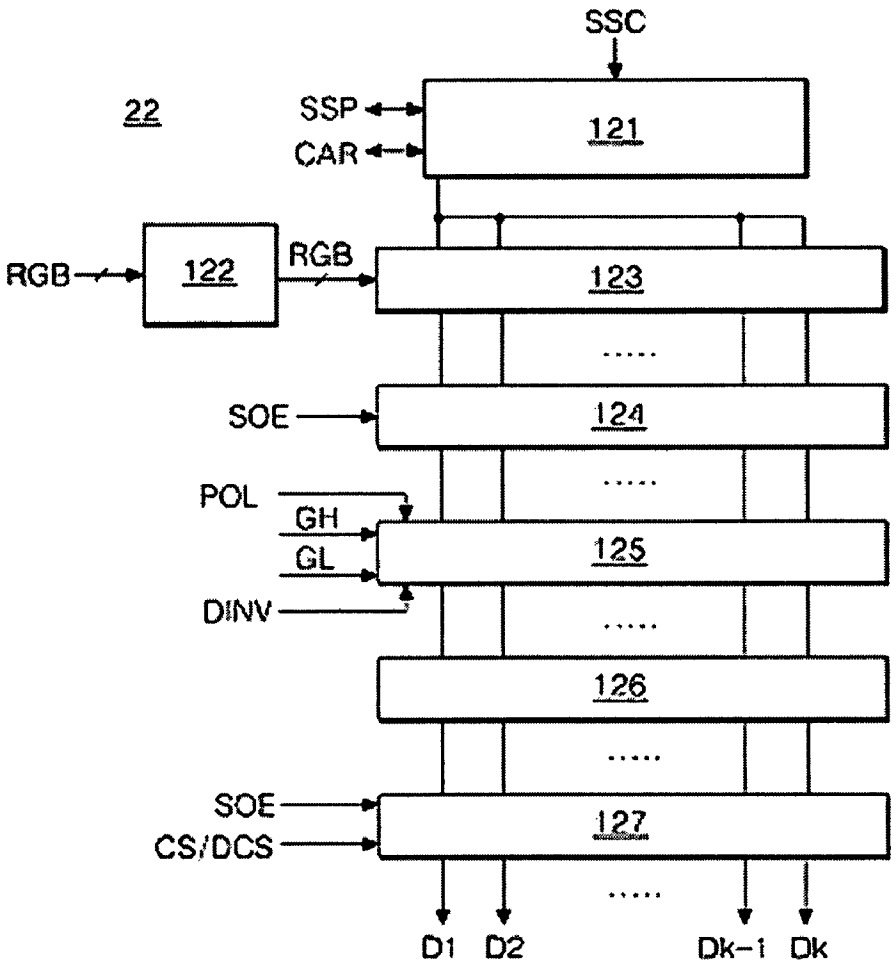
FIG. 15 is an exemplary circuit diagram of the data driving circuit shown in FIG. 9.

FIG. 15 is an exemplary circuit diagram of the data driving circuit 22. As shown in FIG. 15, the data driving circuit 22 includes a plurality of integrated circuits (ICs) for driving k data lines D1 to Dk (where k is an integer smaller than m). Each of the ICs includes a shift register 121, a data register 122, a first latch 123, a second latch 124, a digital/analog converter (hereinafter, referred to as "DAC") 125, an output circuit 126, and a charge sharing circuit 127.

The shift register 121 shifts the source start pulse SSP received from the timing controller 21 in response to the source sampling clock SSC and generates sampling signals. The shift register 121 also shifts the source start pulse SSP and transfers a carry signal CAR to the shift register 121 of an IC of the next stage. The data register 122 temporarily stores the digital video data RGB received from the timing controller 21 and supplies the stored digital video data RGB to the first latch 123. The first latch 123 samples the digital video data RGB received from the data register 122 in response to the sampling signals that are sequentially received from the shift register 121, latches the digital video data RGB, and outputs the digital video data at the same time. The second latch 124 latches the digital video data received from the first latch 123 and then outputs the digital video data, which are latched simultaneously with that of the second latch 124 of other ICs, when the source output enable signal SOE is a logic low.

The DAC 125 converts the digital video data received from the second latch 124 into a positive gamma compensation voltage GH or a negative gamma compensation voltage GL, which are analog positive/negative data voltages, in response to the polarity control signal POL and the dot inversion control signal DINV. The polarity control signal POL determines the polarity of liquid crystal cells vertically adjacent to one another, and the dot inversion control signal DINV decides the polarity of liquid crystal cells horizontally adjacent to one another. Thus, the polarity inversion time of the vertical dot inversion method is determined by the inversion period of the polarity control signal POL, and the polarity inversion time of the horizontal dot inversion method is determined by the dot inversion control signal DINV. When data of weakness patterns are detected by the timing controller 21, the dot inversion control signal DINV is generated as a high logic so that liquid crystal cells are driven according to the horizontal 2-dot inversion method.

The output circuit 126 includes buffers to minimize signal attenuation of analog data voltages supplied to the data lines D1 to Dk. The charge sharing circuit 127 supplies a charge share voltage or a common voltage Vcom to the data lines D1 to Dk during a high logic period of the source output enable signal SOE when the DCS signal is a low logic.

Figure 16:
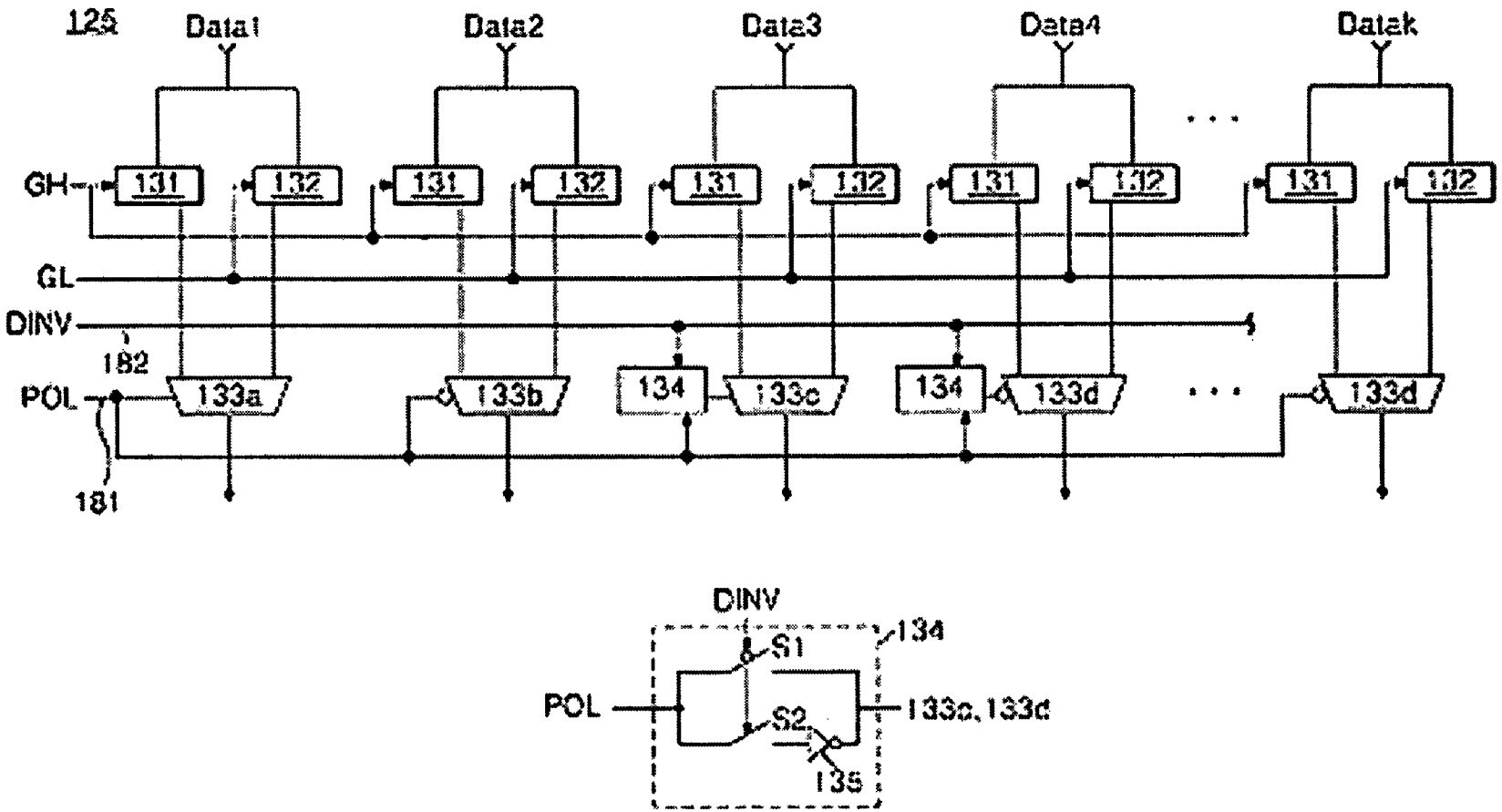
FIG. 16 is an exemplary circuit diagram of a DAC shown in FIG. 15.

FIG. 16 is an exemplary circuit diagram of the DAC 125. As shown in FIG. 16, the DAC 125 according to an exemplary embodiment of the present invention includes P-decoders (PDEC) 131 to which the positive gamma compensation voltage GH is supplied, N-decoders (NDEC) 132 to which the negative gamma compensation voltage GL is supplied, and multiplexers 133 for selecting between the output of the P-decoder 131 and the output of the N-decoder 132 in response to the polarity control signal POL and the dot inversion control signal DINV. The DAC 125 further includes horizontal output inversion circuits 134 for inverting the logic level of a select control signal applied to the control terminals of some of the multiplexers (e.g., 133*c* and 133*d*) in response to the dot inversion control signal DINV.

The P-decoder 131 decodes digital video data received from the second latch 124 and outputs a positive gamma compensation voltage corresponding to a gray level value of the digital video data. The N-decoder 132 decodes digital video data received from the second latch 124 and outputs a negative gamma compensation voltage corresponding to a gray level value of the digital video data. The multiplexer 133 includes (4i+1)th and (4i+2)th multiplexers (e.g., 133*a* and 133*b*), which are directly controlled according to the polarity control signal POL, and (4i+3)th and (4i+4)th multiplexers (e.g., 133*c* and 133*d*), which are controlled according to the output of the horizontal output inversion circuits 134.

The (4i+1)th multiplexer 133*a* alternately selects between the gamma compensation voltage of a positive polarity and the gamma compensation voltage of a negative polarity every inversion period of the polarity control signal POL in response to the polarity control signal POL input to its non-inversion control terminal and outputs the selected positive/negative gamma compensation voltages as analog data voltages. The (4i+2)th multiplexer 133*b* alternately selects between the gamma compensation voltage of a positive polarity and the gamma compensation voltage of a negative polarity every inversion period of the polarity control signal POL in response to the polarity control signal POL input to its inversion control terminal and outputs the selected positive/negative gamma compensation voltages as analog data voltages.

The (4i+3)th multiplexer 133*c* alternately selects between the gamma compensation voltage of a positive polarity and the gamma compensation voltage of a negative polarity every inversion period of the polarity control signal POL in response to the output of the horizontal output inversion circuit 134 input to its non-inversion control terminal and outputs the selected positive/negative gamma compensation voltages as analog data voltages. The (4i+4)th multiplexer 133*d* alternately selects between the gamma compensation voltage of a positive polarity and the gamma compensation voltage of a negative polarity every inversion period of the polarity control signal POL in response to the output of the horizontal output inversion circuit 134 input to its inversion control terminal and outputs the selected positive/negative gamma compensation voltages as analog data voltages.

The horizontal output inversion circuit 134 includes switching elements S1 and S2 and an inverter 135. The horizontal output inversion circuit 134 controls the logic value of the select control signal supplied to the control terminals of the (4i+3)th multiplexer 133*c* and the (4i+4)th multiplexer 133*d* in response to the dot inversion control signal DINV. The inverter 135 is connected to the output terminal of the second switching elements S2 and the non-inversion/inversion control terminals of the (4i+3)th or (4i+4)th multiplexers 133*c* or 133*d*.

When the dot inversion control signal DINV is a high logic, the second switching element S2 is turned on and the first switching element S1 is turned off. Accordingly, the non-inversion control terminal of the (4i+3)th multiplexer 133*c* and the inversion control terminal of the (4i+4)th multiplexer 133*d* are supplied with the polarity control signal POL that is inverted. When the dot inversion control signal DINV is a low logic, the first switching element S1 is turned on and the second switching element S2 is turned off. Accordingly, the non-inversion control terminal of the (4i+3)th multiplexer 133*c* and the inversion control terminal of the (4i+4)th multiplexer 133*d* are supplied with the polarity control signal POL as is.

Figure 18:
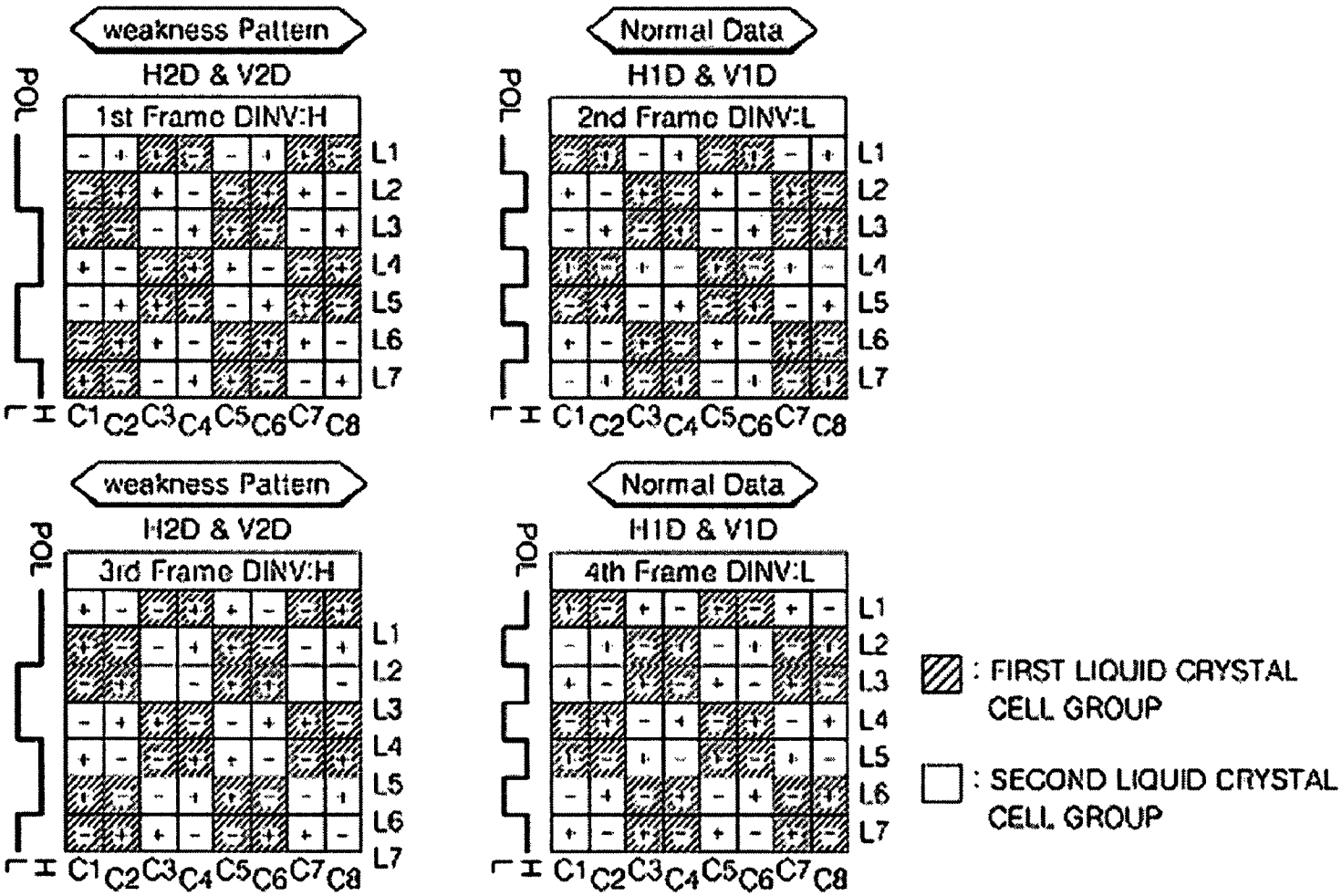
FIGS. 18 and 19 illustrate examples of polarity patterns in which DC image sticking and degradation of picture quality due to weakness patterns are prevented according to an exemplary embodiment of the present invention.
Figure 19:
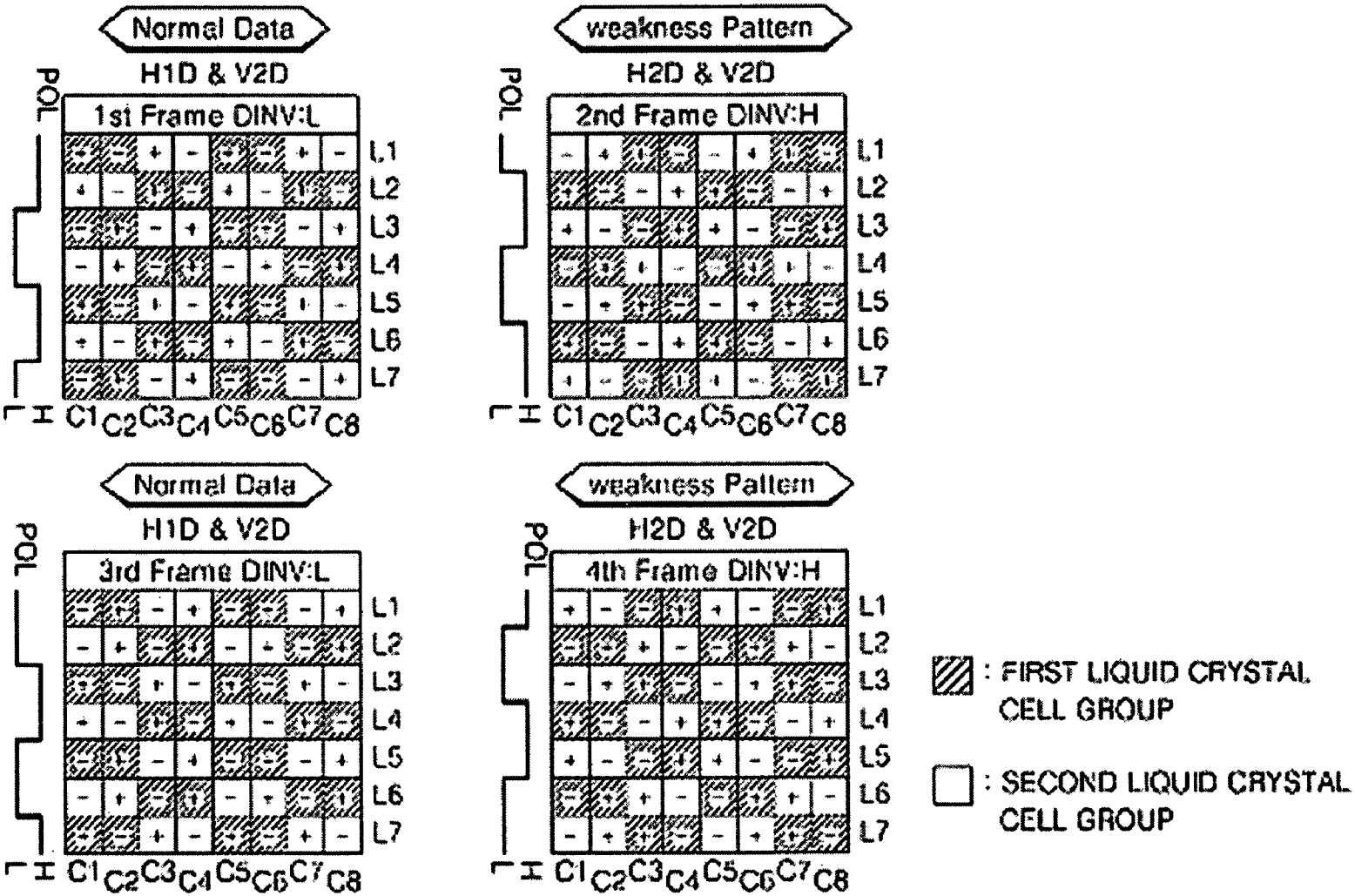

As shown in FIGS. 18 and 19, when the dot inversion control signal DINV is a logic low L, odd line horizontal polarity patterns of data supplied to the data lines are "+−+−" or "−+−+." Accordingly, when the dot inversion control signal DINV is a logic low L, the liquid crystal display is driven according to a horizontal 1-dot inversion method (H1). On the other hand, when the dot inversion control signal DINV is a logic high H, odd line horizontal polarity patterns of data supplied to the data lines are "+−−+" or "−++−." Accordingly, when the dot inversion control signal DINV is a logic high H, the liquid crystal display is driven according to a horizontal 2-dot inversion method (H2).

In the driving method of the liquid crystal display according to an exemplary embodiment of the present invention, a first liquid crystal cell group is driven at a data voltage frequency that is ½ lower than that of a second liquid crystal cell group within 2 frame periods. For example, the first liquid crystal cell group is driven at a data voltage frequency of 30 Hz when the second liquid crystal cell group is driven at a data voltage frequency of 60 Hz, within 2 frame periods. As another example, the first liquid crystal cell group is driven at a data voltage frequency of 60 Hz when the second liquid crystal cell group is driven at a data voltage frequency of 120 Hz, within 2 frame periods. Furthermore, a data voltage whose polarity is inverted every 2 frame periods is supplied to the first liquid crystal cell group in order to prevent DC image sticking, and a data voltage whose polarity is inverted every 1 frame period is supplied to the second liquid crystal cell group in order to prevent a flicker phenomenon.

Figure 17:
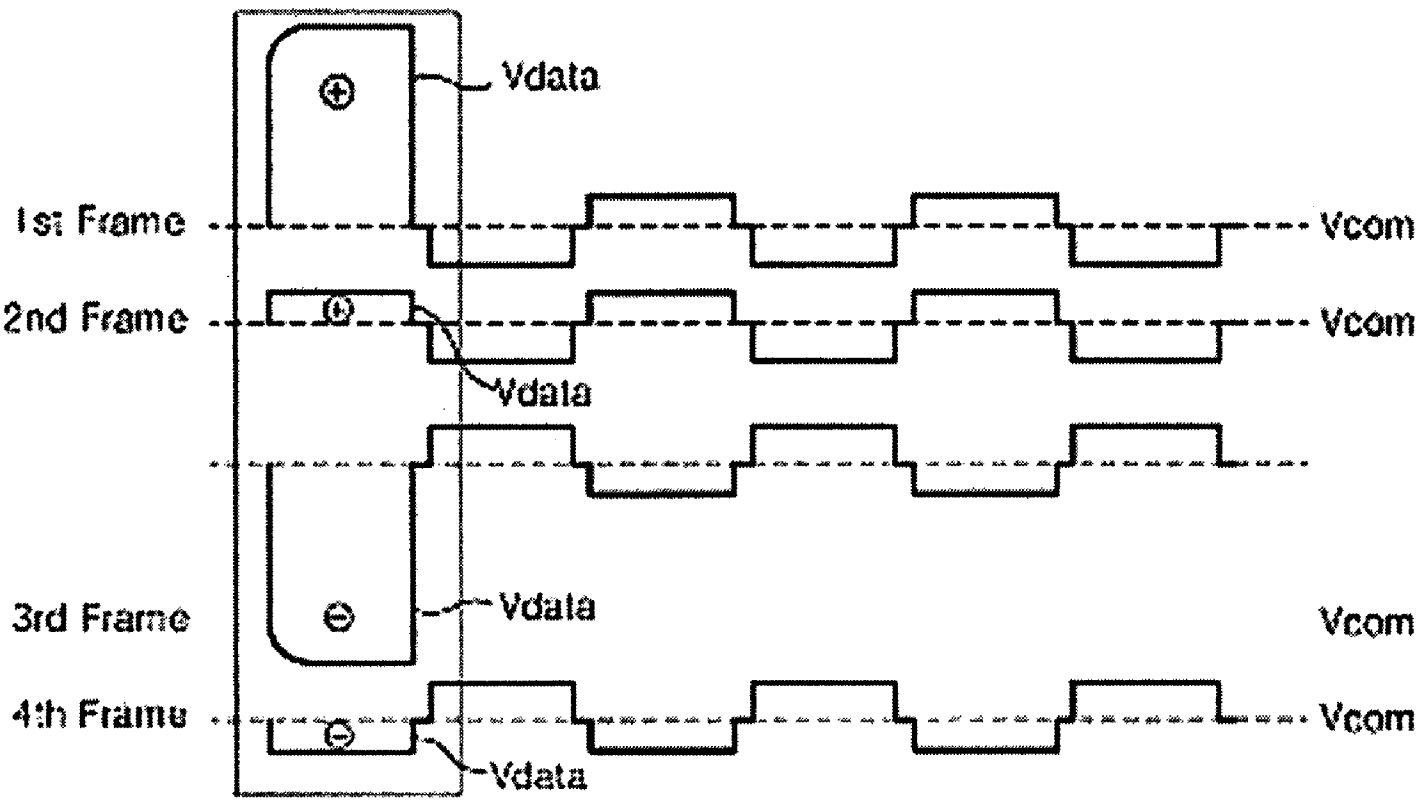
FIG. 17 is a waveform diagram illustrating the effect of preventing DC image sticking according to an exemplary embodiment of the present invention.

FIG. 17 is a waveform diagram illustrating the effect of preventing DC image sticking due to the first liquid crystal cell group according to an exemplary embodiment of the present invention. For purposes of example, as shown in FIG. 17, a high data voltage is supplied to a specific liquid crystal cell Clc included in the first liquid crystal cell group during an odd frame period, a relatively low data voltage is supplied to the liquid crystal cell Clc during an even frame period, and the data voltages are changed every 2 frame periods. Positive data voltages supplied to the liquid crystal cell Clc of the first liquid crystal cell group during first and second frame periods and negative data voltages supplied to the liquid crystal cell Clc of the first liquid crystal cell group during third and fourth frame periods cancel each other, thereby preventing accumulation of voltages with a dominant polarity in the liquid crystal cell Clc. Accordingly, DC image sticking may be prevented due to the first liquid crystal cell group even if the data voltages are of an interlaced image.

While the first liquid crystal cell group may prevent DC image sticking, a flicker phenomenon may still result since the data voltages of the same polarity are supplied to the liquid crystal cell Clc every 2 frame periods. However, flicker is rarely perceived by the human eye when data voltages whose polarity is inverted every frame period is applied to the liquid crystal cells Clc of the second liquid crystal cell group. This is because human eyes are sensitive to a change and therefore recognize the faster driving frequency of the second liquid crystal cell group as the driving frequency of the first liquid crystal cell group when viewing a liquid crystal display in which the first liquid crystal cell group and the second liquid crystal cell group having different driving frequencies coexist.

FIGS. 18 and 19 illustrate exemplary polarity patterns of data voltages in which DC image sticking and the degradation of the picture quality due to weakness patterns may be prevented. For purposes of example, FIG. 18 shows that when the data check by the timing controller 21 of the digital video data input during first and third frame periods detects weakness patterns as shown in FIGS. 3 to 5, the timing controller 21 generates a high logic H dot inversion control signal DINV during the first and third frame periods. On the other hand, when the data check by the timing controller 21 of the digital video data input during second and fourth frame periods detects data patterns other than weakness patterns (i.e., normal data pattern), the timing controller 21 generates a low logic L dot inversion control signal DINV during the second and fourth frame periods. Accordingly, the data voltages supplied to the liquid crystal cells of the liquid crystal display panel 20 are applied according to the horizontal 2-dot inversion method (H2) during the first and third frame periods, and the data voltages supplied to the liquid crystal cells of the liquid crystal display panel 20 are applied according to the horizontal 1-dot inversion method (H1) during the second and fourth frame periods.

During a (4i+1)th frame period (where i is a positive integer) in which data of weakness patterns are input, the first liquid crystal cell group is defined by liquid crystal cells Clc that are disposed in the (4i+1)th and (4i+2)th vertical lines (e.g., C1, C2, C5, and C6) and (4i+2)th and (4i+3)th horizontal lines (e.g., L2, L3, L6, and L7), and liquid crystal cells Clc that are disposed in the (4i+3)th and (4i+4)th vertical lines (e.g., C3, C4, C7, and C8) and (4i+1)th and (4i+4)th horizontal lines (e.g., L1, L4, and L5). A second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+3)th and (4i+4)th vertical lines (e.g., C3, C4, C7, and C8) and the (4i+2)th and (4i+3)th horizontal lines (e.g., L2, L3, L6, and L7), and liquid crystal cells Clc that are disposed in the (4i+1)th and (4i+2)th vertical lines (e.g., C1, C2, C5, and C6) and the (4i+1)th and (4i+4)th horizontal lines (e.g., L1, L4, and L5). In this example, each of the first and second liquid crystal cell groups is defined by every 2×2 liquid crystal cells that are adjacent to one another in the vertical and horizontal directions. The polarities of the liquid crystal cells, which are adjacent to one another within the 2×2 liquid crystal cell, are opposite to each other. The liquid crystal cells of the first liquid crystal cell group and the liquid crystal cells of the second liquid crystal cell group adjacent to the first liquid crystal cell group are charged with the data voltages of the same polarity. To this end, the polarity control signal POL generated during the (4i+1)th frame period has its polarity inverted every 2 horizontal periods corresponding to 2 horizontal synchronization signals. Accordingly, the data driving circuit 22 outputs the data voltages of the same polarity through two adjacent output channels in response to the polarity control signal POL and inverts the polarity of the data voltages every two output channels in order to supply the data voltages of the same polarity to two liquid crystal cells, which are horizontally adjacent to each other, during the (4i+1)th frame period. Further, the data driving circuit inverts the polarity of data voltages every 2 horizontal periods in response to the polarity control signal POL in order to invert the polarity of the data voltages every 2 horizontal periods during the (4i+1)th frame period. During the (4i+1)th frame period, the first and second liquid crystal cell groups are driven according to the horizontal 2-dot inversion (H2D) and vertical 2-dot inversion (V2D) method.

During a (4i+2)th frame period in which data other than weakness patterns are input (i.e., normal data patterns), the first liquid crystal cell group is defined by liquid crystal cells Clc disposed in the (4i+3)th and (4i+4)th vertical lines (e.g., C3, C4, C7, and C8) and the (4i+2)th and (4i+3)th horizontal lines (e.g., L2, L3, L6, and L7), and liquid crystal cells Clc that are disposed in the (4i+1)th and (4i+2)th vertical lines (e.g., C1, C2, C5, and C6) and the (4i+1)th and (4i+4)th horizontal lines (e.g., L1, L4, and L5). The second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+1)th and (4i+2)th vertical lines (e.g., C1, C2, C5, and C6) and the (4i+2)th and (4i+3)th horizontal lines (e.g., L2, L3, L6, and L7), and liquid crystal cells Clc that are disposed in the (4i+3)th and (4i+4)th vertical lines (e.g., C3, C4, C7, and C8) and the (4i+1)th and (4i+4)th horizontal lines (e.g., L1, L4, and L5). In this example, each of the first and second liquid crystal cell groups is defined by every 2×2 liquid crystal cells that are adjacent to one another in the vertical and horizontal directions. The polarities of adjacent liquid crystal cells are opposite to one another within the 2×2 liquid crystal cell. The liquid crystal cells of the first liquid crystal cell group and the liquid crystal cells of the second liquid crystal cell group adjacent to the first liquid crystal cell group are charged with data voltages of different polarities. To this end, the polarity control signal POL generated during the (4i+2)th frame period has its polarity inverted every horizontal period. Accordingly, the data driving circuit 22 outputs data voltages of different polarities through adjacent output channels in response to the polarity control signal POL and inverts the polarity of the data voltages every horizontal period in order to invert the polarity of the data voltages every liquid crystal cell in each of the vertical and horizontal directions during the (4i+2)th frame period. During the (4i+2)th frame period, the first and second liquid crystal cell groups are driven according to the horizontal 1-dot inversion (H1D) and vertical 1-dot inversion (V1D) method.

During a (4i+3)th frame period in which data of weakness patterns are input, the first liquid crystal cell group is defined by liquid crystal cells Clc that are disposed in the (4i+1)th and (4i+2)th vertical lines (e.g., C1, C2, C5, and C6) and the (4i+2)th and (4i+3)th horizontal lines (e.g., L2, L3, L6, and L7), and liquid crystal cells Clc that are disposed in the (4i+3)th and (4i+4)th vertical lines (e.g., C3, C4, C7, and C8) and the (4i+1)th and (4i+4)th horizontal lines (e.g., L1, L4, and L5). The second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+3)th and (4i+4)th vertical lines (e.g., C3, C4, C7, and C8) and the (4i+2)th and (4i+3)th horizontal lines (e.g., L2, L3, L6, and L7), and liquid crystal cells Clc that are disposed in the (4i+1)th and (4i+2)th vertical lines (e.g., C1, C2, C5, and C6) and the (4i+1)th and (4i+4)th horizontal lines (e.g., L1, L4, and L5). In this example, each of the first and second liquid crystal cell groups is defined by every 2×2 liquid crystal cells that are adjacent to one another in the vertical and horizontal directions. The polarities of the liquid crystal cells adjacent to one another within the 2×2 liquid crystal cell are opposite to each other. The liquid crystal cells of the first liquid crystal cell group and the liquid crystal cells of the second liquid crystal cell group adjacent to the first liquid crystal cell group are charged with data voltages of the same polarity. The polarity of the data voltages supplied to the liquid crystal cells of each of the first and second liquid crystal cell groups during the (4i+3)th frame period is opposite to the polarity of the data voltages generated during the (4i+1)th frame period. To this end, the polarity control signal POL generated during the (4i+3)th frame period has its polarity inverted every 2 horizontal periods and has its phase inverted with respect to the polarity control signal POL generated during the (4i+1)th frame period. Accordingly, the data driving circuit 22 outputs the data voltages of the same polarity through two adjacent output channels and inverts the polarity of the data voltages every two output channels in response to the polarity control signal POL in order to supply data voltages of the same polarity to two liquid crystal cells, which are horizontally adjacent to each other, during the (4i+3)th frame period. Further, the data driving circuit 22 inverts the polarity of the data voltages every 2 horizontal periods in response to the polarity control signal POL in order to invert the polarity of the data voltages every 2 horizontal periods during the (4i+3)th frame period. During the (4i+3)th frame period, the first and second liquid crystal cell groups are driven according to the horizontal 2-dot inversion (H2D) and vertical 2-dot inversion (V2D) method.

During a (4i+4)th frame period in which data other than weakness patterns are input, the first liquid crystal cell group is defined by liquid crystal cells Clc that are disposed in the (4i+3)th and (4i+4)th vertical lines (e.g., C3, C4, C7, and C8) and the (4i+2)th and (4i+3)th horizontal lines (e.g., L2, L3, L6, and L7), and liquid crystal cells Clc that are disposed in the (4i+1)th and (4i+2)th vertical lines (e.g., C1, C2, C5, and C6) and the (4i+1)th and (4i+4)th horizontal lines (e.g., L1, L4, and L5). The second liquid crystal cell group is defined by the liquid crystal cells Clc interposed between the first liquid crystal cell groups in the vertical and horizontal directions: In this instance, the second liquid crystal cell group is defined by liquid crystal cells Clc that are disposed in the (4i+1)th and (4i+2)th vertical lines (e.g., C1, C2, C5, and C6) and the (4i+2)th and (4i+3)th horizontal lines (e.g., L2, L3, L6, and L7), and liquid crystal cells Clc that are disposed in the (4i+3)th and (4i+4)th vertical lines (e.g., C3, C4, C7, and C8) and the (4i+1)th and (4i+4)th horizontal lines (e.g., L1, L4, and L5). In this example, each of the first and second liquid crystal cell groups is defined by every 2×2 liquid crystal cells that are adjacent to one another in the vertical and horizontal directions. The polarities of adjacent liquid crystal cells are opposite to one another within the 2×2 liquid crystal cell. The liquid crystal cells of the first liquid crystal cell group and the liquid crystal cells of the second liquid crystal cell group adjacent to the first liquid crystal cell group are charged with data voltages of different polarities. The polarity of data voltages supplied to the liquid crystal cells of each of the first and second liquid crystal cell groups during the (4i+4)th frame period is opposite to that of data voltages generated during the (4i+2)th frame period. To this end, the polarity control signal POL generated during the (4i+4)th frame period has its polarity inverted every horizontal period and has its phase inverted with respect to the polarity control signal POL generated during the (4i+2)th frame period. The data driving circuit 22 outputs data voltages of different polarities through adjacent output channels in response to the polarity control signal POL and inverts the polarity of the data voltages every horizontal period in order to invert the polarity of the data voltages every liquid crystal cell in each of the vertical and horizontal directions during the (4i+4)th frame period. During the (4i+4)th frame period, the first and second liquid crystal cell groups are driven according to the horizontal 1-dot inversion (H1D) and vertical 1-dot inversion (V1D) method.

For purposes of example, as shown in FIG. 19, when data check by the timing controller 21 of digital video data input during the second and fourth frame periods detects weakness patterns as shown in FIGS. 3 to 5, the timing controller 21 generates a high logic H dot inversion control signal DINV during the second and fourth frame periods. When the data check of digital video data input during the first and third frame periods detects data patterns other than weakness patterns, the timing controller 21 generates a low logic L dot inversion control signal DINV during the first and third frame periods. Accordingly, the data voltages applied to the liquid crystal cells of the liquid crystal display panel 20 are supplied according to the horizontal 2-dot inversion method (H2) during the second and fourth frame periods, and the data voltages applied to the liquid crystal cells of the liquid crystal display panel 20 are supplied according to the horizontal 1-dot inversion method (H1) during the first and third frame periods.

During a (4i+1)th frame period in which data other than weakness patterns are input, a first liquid crystal cell group is defined by liquid crystal cells Clc that are disposed in the (4i+1)th and (4i+2)th vertical lines (e.g., C1, C2, C5, and C6) and (4i+1)th and (4i+3)th horizontal lines (e.g., L1, L3, L5, and L7), and liquid crystal cells Clc that are disposed in the (4i+3)th and (4i+4)th vertical lines (e.g., C3, C4, C7, and C8) and the (4i+2)th and (4i+4)th horizontal lines (e.g., L2, L4, and L6). A second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+3)th and (4i+4)th vertical lines (e.g., C3, C4, C7, and C8) and the (4i+1)th and (4i+3)th horizontal lines (e.g., L1, L3, L5, and L7), and liquid crystal cells Clc that are disposed in the (4i+1)th and (4i+2)th vertical lines (e.g., C1, C2, C5, and C6) and the (4i+2)th and (4i+4)th horizontal lines (e.g., L2, L4, and L6). In this example, each of the first and second liquid crystal cell groups is defined by every 2×1 liquid crystal cells that are adjacent to one another in the horizontal direction. The polarities of the liquid crystal adjacent to one another within the 2×1 liquid crystal cell are opposite to each other. The liquid crystal cells of the first liquid crystal cell group and the liquid crystal cells of the second liquid crystal cell group adjacent to the first liquid crystal cell group are charged with data voltages of different polarities. To this end, the polarity control signal POL generated during the (4i+1)th frame period has its polarity inverted every 2 horizontal periods. The data driving circuit 22 inverts the polarity of the data voltages in response to the polarity control signal POL in order to invert the polarity of the data voltages every 2 horizontal periods during the (4i+1)th frame period. During the (4i+1)th frame period, the first and second liquid crystal cell groups are driven according to the horizontal 1-dot inversion (H1D) and vertical 2-dot inversion (V2D) method.

During a (4i+2)th frame period in which data of weakness patterns are input, the first liquid crystal cell group is defined by liquid crystal cells Clc that are disposed in the (4i+3)th and (4i+4)th vertical lines (e.g., C3, C4, C7, and C8) and the (4i+1)th and (4i+3)th horizontal lines (e.g., L1, L3, L5, and L7), and liquid crystal cells Clc that are disposed in the (4i+1)th and (4i+2)th vertical lines (e.g., C1, C2, C5, and C6) and the (4i+2)th and (4i+4)th horizontal lines (e.g., L2, L4, and L6). The second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+1)th and (4i+2)th vertical lines (e.g., C1, C2, C5, and C6) and the (4i+1)th and (4i+3)th horizontal lines (e.g., L1, L3, L5, and L7), and liquid crystal cells Clc that are disposed in the (4i+3)th and (4i+4)th vertical lines (i.e., C3, C4, C7, and C8) and the (4i+2)th and (4i+4)th horizontal lines (e.g., L2, L4, and L6). In this example, each of the first and second liquid crystal cell groups is defined by every 2×1 liquid crystal cells that are adjacent to one another in the horizontal direction. The polarities of the data voltages charged in the adjacent liquid crystal cells within the 2×1 liquid crystal cells are opposite to each other. The liquid crystal cells of the first liquid crystal cell group and the liquid crystal cells of the second liquid crystal cell group adjacent to the first liquid crystal cell group are charged with data voltages of the same polarity. To this end, the polarity control signal POL generated during the (4i+2)th frame period has its polarity inverted every 2 horizontal periods and is generated with a phase difference of 1 horizontal period with respect to the polarity control signal POL generated during the (4i+1)th frame period is generated. The data driving circuit 22 inverts the polarity of the data voltages in response to the polarity control signal POL in order to invert the polarity of the data voltages every 2 horizontal periods. During the (4i+2)th frame period, the first and second liquid crystal cell groups are driven according to the horizontal 2-dot inversion (H2D) and vertical 2-dot inversion (V2D) method.

During a (4i+3)th frame period in which data other than weakness patterns are input, the first liquid crystal cell group is defined by liquid crystal cells Clc that are disposed in the (4i+1)th and (4i+2)th vertical lines (e.g., C1, C2, C5, and C6) and the (4i+1)th and (4i+3)th horizontal lines (e.g., L1, L3, L5, and L7), and liquid crystal cells Clc that are disposed in the (4i+3)th and (4i+4)th vertical lines (e.g., C3, C4, C7, and C8) and the (4i+2)th and (4i+4)th horizontal lines (e.g., L2, L4, and L6). The second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+3)th and (4i+4)th vertical lines (e.g., C3, C4, C7, and C8) and the (4i+1)th and (4i+3)th horizontal lines (e.g., L1, L3, L5, and L7), and liquid crystal cells Clc that are disposed in the (4i+1)th and (4i+2)th vertical lines (e.g., C1, C2, C5, and C6) and the (4i+2)th and (4i+4)th horizontal lines (e.g., L2, L4, and L6). In this example, each of the first and second liquid crystal cell groups is defined by every 2×1 liquid crystal cells that are adjacent to one another in the vertical and horizontal directions. The polarities of the liquid crystal cells adjacent to each other within the 2×1 liquid crystal cell are opposite to each other. The liquid crystal cells of the first liquid crystal cell group and the liquid crystal cells of the second liquid crystal cell group adjacent to the first liquid crystal cell group are charged with data voltages of different polarities. The polarity of the data voltages supplied to the liquid crystal cells of each of the first and second liquid crystal cell groups during the (4i+3)th frame period is opposite to that of the data voltages generated during the (4i+1)th frame period. To this end, the polarity control signal POL generated during the (4i+3)th frame period has its polarity inverted every 2 horizontal periods and is generated as an inverted logic level with respect to the polarity control signal POL generated during the (4i+1)th frame period. The data driving circuit 22 outputs data voltages of the same polarity through two adjacent output channels in response to the polarity control signal POL and inverts the polarity of the data voltages every two output channels in order to supply the data voltages having the same polarity to two liquid crystal cells, which are horizontally adjacent to each other, during the (4i+3)th frame period. Further, the data driving circuit 22 inverts the polarity of the data voltages in response to the polarity control signal POL in order to invert the polarity of the data voltages every 2 horizontal periods. During the (4i+3)th frame period, the first and second liquid crystal cell groups are driven according to the horizontal 1-dot inversion (H1D) and vertical 2-dot inversion (V2D) method.

During a (4i+4)th frame period in which data of weakness patterns are input, the first liquid crystal cell group is defined by liquid crystal cells Clc that are disposed in the (4i+3)th and (4i+4)th vertical lines (e.g., C3, C4, C7, and C8) and the (4i+1)th and (4i+3)th horizontal lines (e.g., L1, L3, L5, and L7), and liquid crystal cells Clc that are disposed in the (4i+1)th and (4i+2)th vertical lines (e.g., C1, C2, C5, and C6) and the (4i+2)th and (4i+4)th horizontal lines (e.g., L2, L4, and L6). The second liquid crystal cell group is defined by the liquid crystal cells Clc interposed between the first liquid crystal cell groups in the vertical and horizontal directions. In this instance, the second liquid crystal cell group is defined by liquid crystal cells Clc that are disposed in the (4i+1)th and (4i+2)th vertical lines (e.g., C1, C2, C5, and C6) and the (4i+1)th and (4i+3)th horizontal lines (e.g., L1, L3, L5, and L7), and liquid crystal cells Clc that are disposed in the (4i+3)th and (4i+4)th vertical lines (e.g., C3, C4, C7, and C8) and the (4i+2)th and (4i+4)th horizontal lines (e.g., L2, L4, and L6). In this example, each of the first and second liquid crystal cell groups is defined by every 2×1 liquid crystal cells that are adjacent to one another in the vertical and horizontal directions. The polarities of the liquid crystal cells adjacent to each other within the 2×1 liquid crystal cell are opposite to each other. The liquid crystal cells of the first liquid crystal cell group and the liquid crystal cells of the second liquid crystal cell group adjacent to the first liquid crystal cell group are charged with data voltages of the same polarity. The polarity of the data voltages supplied to the liquid crystal cells of each of the first and second liquid crystal cell groups during the (4i+4)th frame period is opposite to that of the data voltages generated during the (4i+2)th frame period. To this end, the polarity control signal POL generated during the (4i+4)th frame period has its polarity inverted every 2 horizontal periods and is generated as an inverted logic level with respect to the polarity control signal POL generated during the (4i+2)th frame period. The data driving circuit 22 inverts the polarity of the data voltages in response to the polarity control signal POL in order to invert the polarity of the data voltages every 2 horizontal periods during the (4i+4)th frame period. During the (4i+4)th frame period, the first and second liquid crystal cell groups are driven according to the horizontal 2-dot inversion (H2D) and vertical 2-dot inversion (V2D) method.

In accordance with the liquid crystal display and the driving method thereof according to an exemplary embodiment of the present invention, when weakness patterns are input, the driving method may be switched to not only the horizontal 2-dot inversion method but also to any horizontal N-dot inversion method (where N is an integer higher than 2) to reduce the greenish phenomenon or the flicker phenomenon in the weakness patterns.

In accordance with the liquid crystal display and the driving method thereof according to an exemplary embodiment of the present invention, gray levels of data are checked and charge sharing is performed only when the gray levels of the data are changed from the white gray level to the black gray level at data voltages of the same polarity and only a time at which the polarity of the data voltage is inverted. Accordingly, the generation of heat and power consumption of the data driving circuit may be reduced. Further, according to the liquid crystal display and the driving method thereof in accordance with an exemplary embodiment of the present invention, the polarity of data voltages supplied to liquid crystal cells is inverted every 2 frame periods and periods where the polarity of data voltages supplied to adjacent liquid crystal cells is inverted are controlled to overlap. Accordingly, image problems such as DC image sticking and flicker may be prevented at the same time. In addition, when data of weakness patterns in which data of the white gray level and the black gray level are disposed regularly are input, the driving method may be switched to the horizontal 2-dot inversion method. When data other than weakness patterns are input, the driving method may be switched to the horizontal 1-dot inversion method. Accordingly, the degradation of the picture quality in any data pattern may be prevented.

It will be apparent to those skilled in the art that various modifications and variations can be made in the liquid crystal display of the present invention and driving method thereof without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel having a plurality of data lines, a plurality of gate lines, and a plurality of liquid crystal cells;

a timing controller to determine gray levels of input digital video data and a time at which a polarity of a data voltage to be supplied to the data lines is inverted and generate a dynamic charge share control signal to indicate a time at which the gray level of the data voltage is changed from a white gray level to a black gray level and a time at which the polarity of the data voltage is inverted, and to detect weakness patterns in which the data of the white gray level and the black gray level are regularly arranged in the input digital video data and generate a dot inversion control signal for widening a horizontal polarity inversion time of data voltages to be supplied to the data lines when the weakness patterns are input;

a data driving circuit to convert the digital video data from the timing controller into the data voltage, change the polarity of the data voltage, supply any one of a common voltage and a charge share voltage between a positive data voltage and a negative data voltage to the data lines in response to the dynamic charge share control signal, and widen the horizontal polarity inversion time of the data voltages in response to the dot inversion control signal; and a gate driving circuit to sequentially supply a scan pulse to the gate lines under the control of the timing controller, wherein the liquid crystal display panel includes first and second liquid crystal cell groups whose polarity is inverted every 2 frame periods, and a polarity inversion time of the first liquid crystal cell group and a polarity inversion time of the second liquid crystal cell group overlap, and wherein charge sharing is performed using any one of the common voltage and the charge share voltage only when the gray level of the input digital video data is changed from the white gray level to the black gray level and the polarity of the data voltages supplied to the liquid crystal display panel is inverted.

2. The liquid crystal display of claim 1, wherein the timing controller includes:

a data check unit to analyze the gray level of the digital video data in order to determine whether two digital video data that are input consecutively are changed from the white gray level to the black gray level and generate a first charge share signal to indicate a time at which the digital video data are changed from the white gray level to the black gray level, a polarity check unit to analyze the time at which the polarity of the data voltage to be supplied to the data lines is inverted by counting a gate shift clock for controlling the gate driving circuit and generate a second charge share signal to indicate the time at which the polarity of the data voltage is inverted, a dynamic charge share control signal generator to generate the dynamic charge share. control signal based on the first charge share signal and the second charge share signal, and a dot inversion control signal generator to generate a high logic dot inversion control signal when the weakness patterns are input and a low logic dot inversion control signal when data other than the weakness patterns are input by checking the input digital video data.

3. The liquid crystal display of claim 2, wherein the data driving circuit supplies the data voltages to the data lines as a polarity of a horizontal 1-dot inversion method when the dot inversion signal is a low logic, and the data voltages to the data lines as a polarity of a horizontal 2-dot inversion method when the dot inversion signal is a high logic.

4. A method of driving a liquid crystal display including a liquid crystal display panel having a plurality of data lines, a plurality of gate lines, a plurality of liquid crystal cells, a data driving circuit to convert digital video data into a data voltage to be supplied to the data lines and to convert a polarity of the data voltage, and a gate driving circuit to sequentially supply a scan pulse to the gate lines, the method comprising the steps of:

determining gray levels of digital video data and a time at which the polarity of the data voltage to be supplied to the data lines is inverted;

generating a dynamic charge share control signal to indicate a time at which the gray level of the data voltage is changed from a white gray level to a black gray level and a time at which the polarity of the data voltage is inverted;

detecting a weakness pattern in which data of the white gray level and the black gray level are regularly arranged in the digital video data and generating a dot inversion control signal to widen a horizontal polarity inversion time of data voltages to be supplied to the data lines when the weakness pattern is input;

converting the digital video data into the data voltage, changing the polarity of the data voltage, and supplying any one of a common voltage and a charge share voltage between a positive data voltage and a negative data voltage to the data lines in response to the dynamic charge share control signal; and widening the horizontal polarity inversion time of the data voltages in response to the dot inversion control signal, wherein the liquid crystal display panel includes first and second liquid crystal cell groups whose polarity is inverted every 2 frame periods and a polarity inversion time of the first liquid crystal cell group is controlled to overlap with a polarity inversion time of the second liquid crystal cell group, and wherein charge sharing is performed using any one of the common voltage and the charge share voltage only when the gray level of the input digital video data is changed from the white gray level to the black gray level and the polarity of the data voltages supplied to the liquid crystal display panel is inverted.

5. The method of claim 4, further comprising the steps of:

analyzing the gray level of the digital video data in order to determine whether two digital video data that are input consecutively are changed from the white gray level to the black gray level and generating a first charge share signal to indicate a time at which the digital video data are changed from the white gray level to the black gray level;

analyzing the time at which the polarity of the data voltage to be supplied to the data lines is inverted by counting a gate shift clock for controlling the gate driving circuit and generating a second charge share signal to indicate the time at which the polarity of the data voltage is inverted;

generating the dynamic charge share control signal based on the first charge share signal and the second charge share signal; and analyzing the digital video data to determine the presence of weakness patterns and generating a high logic dot inversion control signal when the weakness patterns are input and a low logic dot inversion control signal when data other than the weakness patterns are input by checking the input digital video data.

6. The method of claim 5, wherein the data driving circuit supplies the data voltages to the data lines as a polarity of a horizontal 1-dot inversion method when the dot inversion signal is a low logic, and the data voltages to the data lines as a polarity of a horizontal 2-dot inversion method when the dot inversion signal is a high logic.

* * * * *